US006467450B1

(12) United States Patent
Arce

(10) Patent No.: US 6,467,450 B1
(45) Date of Patent: Oct. 22, 2002

(54) RADIAL COMBUSTION MOTOR

(75) Inventor: Daniel Esteban Arce, Provincia de Buenos Aires (AR)

(73) Assignee: Paguer, Inc. (AR)

( * ) Notice: Subject to any disclaimer, the term of this patent is extended or adjusted under 35 U.S.C. 154(b) by 0 days.

(21) Appl. No.: 09/879,562

(22) Filed: Jun. 12, 2001

(51) Int. Cl.[7] ..... F02B 53/04
(52) U.S. Cl. ..... 123/236; 123/231; 148/179
(58) Field of Search ..... 123/236, 247, 123/231; 418/86, 178, 179

(56) References Cited

U.S. PATENT DOCUMENTS

| | | | | | |
|---|---|---|---|---|---|
| 2,048,825 | A | * | 7/1936 | Smelser | 123/231 |
| 2,114,674 | A | * | 4/1938 | Buckbee | 123/236 |
| 2,193,178 | A | * | 3/1940 | Laythorpe | 123/236 |
| 3,324,840 | A | * | 6/1967 | Linn | 123/236 |
| 3,537,432 | A | * | 11/1970 | Jordaan | 123/236 |
| 3,726,259 | A | * | 4/1973 | Graves | 123/236 |
| 3,809,020 | A | * | 5/1974 | Takitani | 123/215 |
| 3,858,559 | A | * | 1/1975 | Thomas, Jr. | 123/236 |
| 4,154,208 | A | * | 5/1979 | Kunieda et al. | 123/236 |
| 4,638,776 | A | * | 1/1987 | Crittenden | 123/235 |
| 5,049,052 | A | * | 9/1991 | Aihara | 418/179 |
| 5,352,295 | A | * | 10/1994 | Chou | 123/236 |
| 5,429,084 | A | | 7/1995 | Cherry et al. | |
| 5,735,679 | A | * | 4/1998 | Hutchins | 418/179 |
| 5,954,017 | A | | 9/1999 | Federowicz | |
| 6,003,486 | A | | 12/1999 | Vanmoor | |
| 6,035,630 | A | | 3/2000 | Soos | |

FOREIGN PATENT DOCUMENTS

| | | | | |
|---|---|---|---|---|
| JP | 359215983 A | * | 12/1984 | 418/179 |

* cited by examiner

*Primary Examiner*—Thomas Denion
*Assistant Examiner*—Thai-Ba Trieu
(74) *Attorney, Agent, or Firm*—Banner & Witcoff, Ltd.

(57) ABSTRACT

A radial Combustion motor is provided that includes a compression section, or a combustion section, or both. Each of the combustion section and the compression section includes a cylindrical rotor that rotates in a cylindrical chamber. An inner wall of each chamber includes multiple ridges such that a rotor, when positioned in the rotor's respective chamber, divides the chamber into multiple sub-chambers in conjunction with each of the multiple ridges. Each rotor includes multiple sealing blade slots that each extend the length of the rotor and that each slidably receive one of multiple sealing blades. Rotation of each rotor causes the sealing blades disposed in the sealing blades slots of the rotor to slide outward until an outer edge of each sealing blade slidably engages the inner wall of the associated chamber and to remain engaged with the inner wall for so long as the rotor rotates. Movement of a compression section sealing blade across a sub-chamber of the compression chamber compresses a fuel mixture in the sub-chamber to produce a compressed fuel mixture. The compressed fuel mixture is then conveyed to a sub-chamber of the combustion chamber via multiple fuel apertures, where the compressed fuel mixture is ignited to produce a force that is applied to the sealing blades of the combustion section, thereby causing the combustion rotor, and a shaft coupled to the combustion rotor, to rotate.

39 Claims, 13 Drawing Sheets

FIG.7A
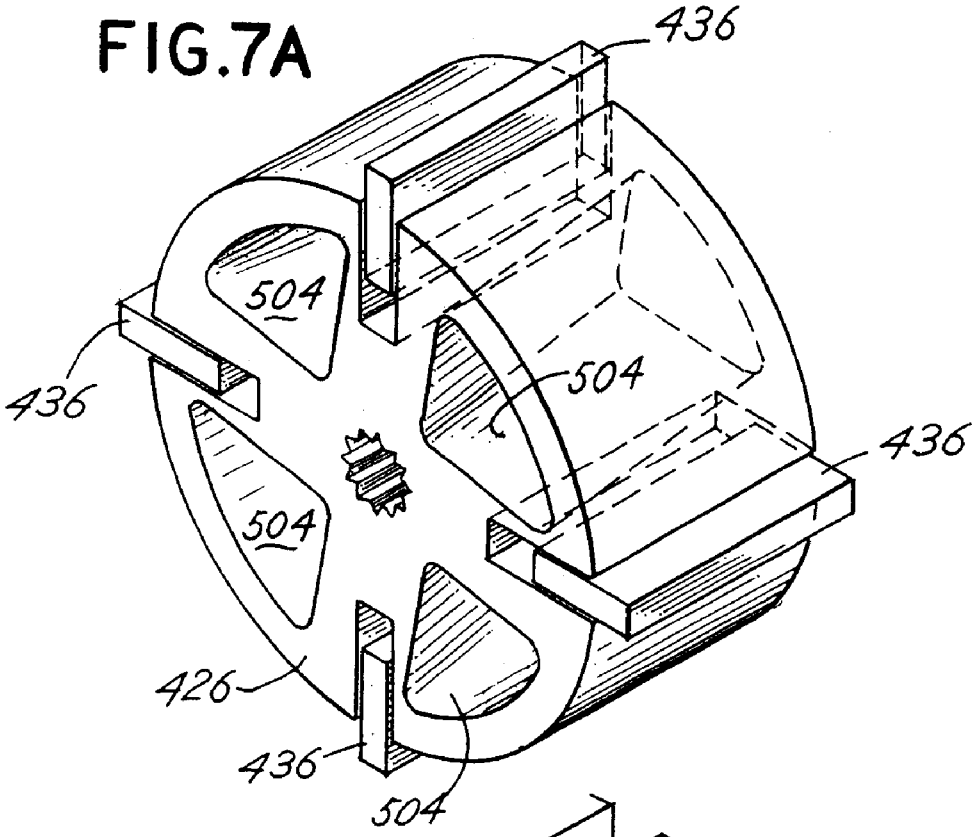
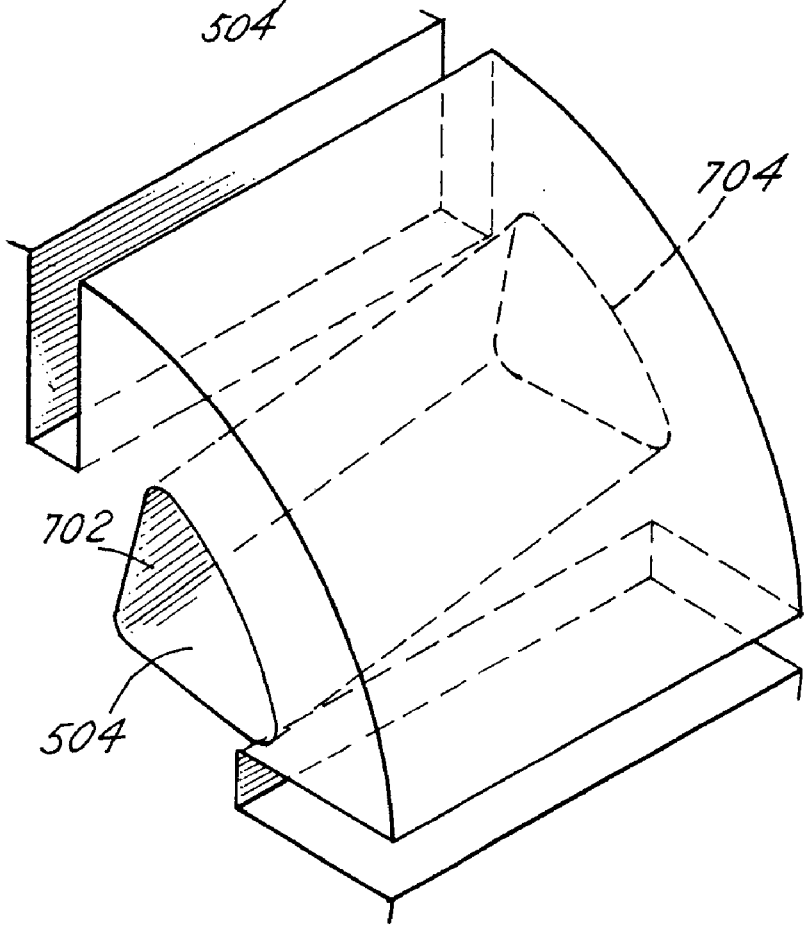
FIG.7B

FIG.8A
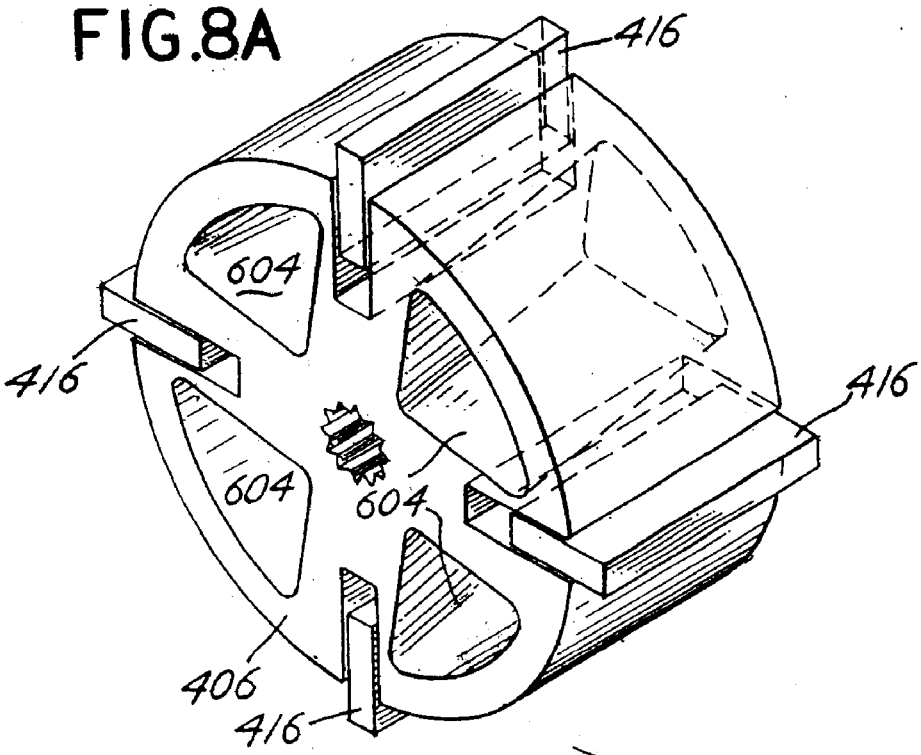
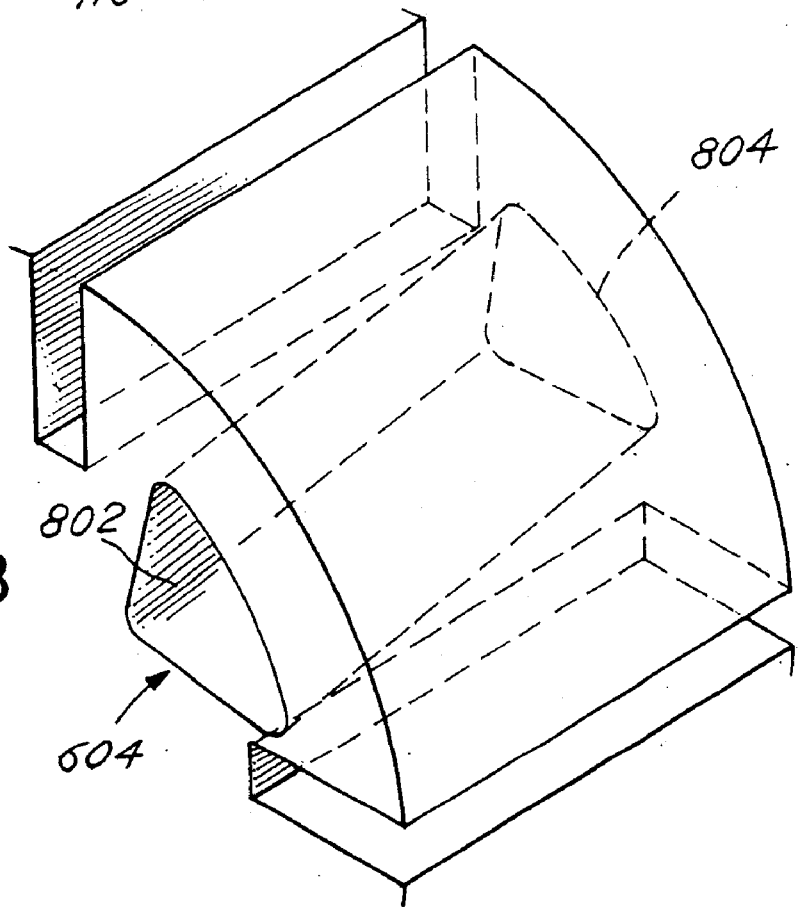
FIG.8B

RADIAL COMBUSTION MOTOR

TECHNICAL FIELD

The present invention relates generally to combustion motors, and in particular to radial combustion motors.

BACKGROUND OF THE INVENTION

A conventional internal combustion engine has an engine block that includes multiple cylinders that each includes a piston. Each piston reciprocates in the piston's respective cylinder, first compressing a combustible fuel and then being driven in the opposite direction by a combustion of the compressed fuel. The reciprocation of the piston provides power to a crankshaft. Each cylinder typically includes multiple valves that are mechanically opened and closed and that each provide an inlet and/or an outlet for gases input to and output by the cylinder. For example, one such valve may permit a combustible fuel into the cylinder and another such valve may allow the exhaust resulting from the combustion of the fuel to escape the cylinder. Typically such engines are complicated in terms of the number of moving parts, resulting in an engine that is complicated and expensive to manufacture and repair. Furthermore, such engines typically have a relatively high size-to-power ratio and are limited in that a piston can provide only one power stroke per revolution of the crankshaft.

To resolve drawbacks of the conventional internal combustion engine, rotary engines, such as the Wankel engine, have been developed that utilize a rotor to compress the fuel. The rotary engines are built of fewer moving parts than the conventional internal combustion engines, making them easier and more economic to construct and repair and providing a lower size-to-power ratio. However, the Wankel engine has proven to be not very efficient and has a high fuel consumption rate. Furthermore, rotary engines such as the Wankel engine have had problems with the sealing of the rotors.

Therefore, a need exists for an motor that is built of fewer moving parts than a conventional internal combustion engine with a lower size-to-power ratio and that does not have the sealing problems presented by using a rotor to seal a combustion chamber.

SUMMARY OF THE INVENTION

To address the need for a motor that is built of fewer moving parts than a conventional internal combustion engine with a lower size-to-power ratio and that does not have the sealing problems presented by using a rotor to seal a combustion chamber, a radial combustion motor is provided that uses rotors and sealing blades to compress a fuel, to seal a combustion chamber, and to produce a torque.

One embodiment, the present invention encompasses a radial combustion motor having a compression section that includes a compression block that houses a compression chamber. The compression chamber is disposed in a fixed position in the compression block and houses a compression rotor. The compression chamber includes an inner wall and an outer wall, and the inner wall includes multiple ridges that each extend approximately a length of the compression chamber. The compression rotor is rotatably positioned in the compression chamber. The compression rotor, in combination with the multiple ridges of the compression rotor chamber, divides an interior of the compression chamber into multiple sub-chambers. The compression rotor includes multiple sealing blade slots positioned in an outer surface of the compression rotor for receiving multiple sealing blades. Each sealing blade of the multiple sealing blades is slidably received by a sealing blade slot of the multiple sealing blade slots, and each sealing blade radially reciprocates in and out of the sealing blade slot when the rotor rotates inside of the compression chamber, thereby subdividing each sub-chamber.

Another embodiment of the present invention encompasses a radial combustion motor having a combustion section that includes a combustion block that houses a combustion chamber. The combustion chamber is disposed in a fixed in position in the combustion block and houses a combustion rotor. The combustion chamber includes an inner wall and an outer wall, and the inner wall of the combustion chamber includes multiple ridges that each extend approximately a length of the combustion chamber. The combustion rotor is rotatably positioned in the combustion chamber. The combustion rotor, in combination with the multiple ridges of the combustion chamber, divides an interior of the combustion chamber into multiple sub-chambers. The combustion rotor includes multiple sealing blade slots positioned in an outer surface of the combustion rotor for receiving multiple sealing blades. Each sealing blade of the multiple sealing blades is slidably received in a sealing blade slot of the multiple sealing blade slots, and each stealing blade radially reciprocates in and out of the sealing blade slot when the rotor rotates inside of the combustion chamber, thereby subdividing each sub-chamber.

Still another embodiment of the present invention encompasses a method for compressing a compressible fuel by a motor comprising a rotor that is rotatably positioned in a compression chamber, wherein the rotor comprises a sealing blade slot that slidably receives a sealing blade. The method includes steps of rotating the rotor, and in response to the rotation of the rotor, applying a centrifugal force to the sealing blade. The method further comprises steps of subdividing the compression chamber into multiple sections based on the centrifugal force and compressing the fuel mixture in a section of the multiple sections by the sealing blade based on the rotation of the rotor.

Yet another embodiment of the present invention encompasses a method for generating a torque by a motor comprising a rotor that is rotatably positioned in a combustion chamber, wherein the rotor comprises a sealing blade slot that slidably receives a sealing blade. The method includes steps of rotating the rotor, and in response to the rotation of the rotor, applying a centrifugal force to the sealing blade. The method further comprises steps of subdividing the combustion chamber into multiple sections based on the centrifugal force and igniting a combustible fuel in a section of the multiple sections. The method further comprises steps of applying a forward force to the sealing blade in response to the ignition of the fuel and applying a torque to the rotor based on the forward force.

BRIEF DESCRIPTION OF THE DRAWINGS

FIG. 7A is an isometric profile of a combustion rotor and associated sealing blades of FIG. 4 in accordance with an embodiment of the present invention.

FIG. 7B is an isometric profile of a quarter section of the combustion rotor of FIG. 7A in accordance with an embodiment of the present invention.

FIG. 8A is an isometric profile of a compression rotor and associated sealing blades of FIG. 4 in accordance with an embodiment of the present invention.

FIG. 8B is an isometric profile of a quarter section of a compression rotor of FIG. 8A in accordance with an, embodiment of the present invention.

DETAILED DESCRIPTION OF THE INVENTION

Figure 1:
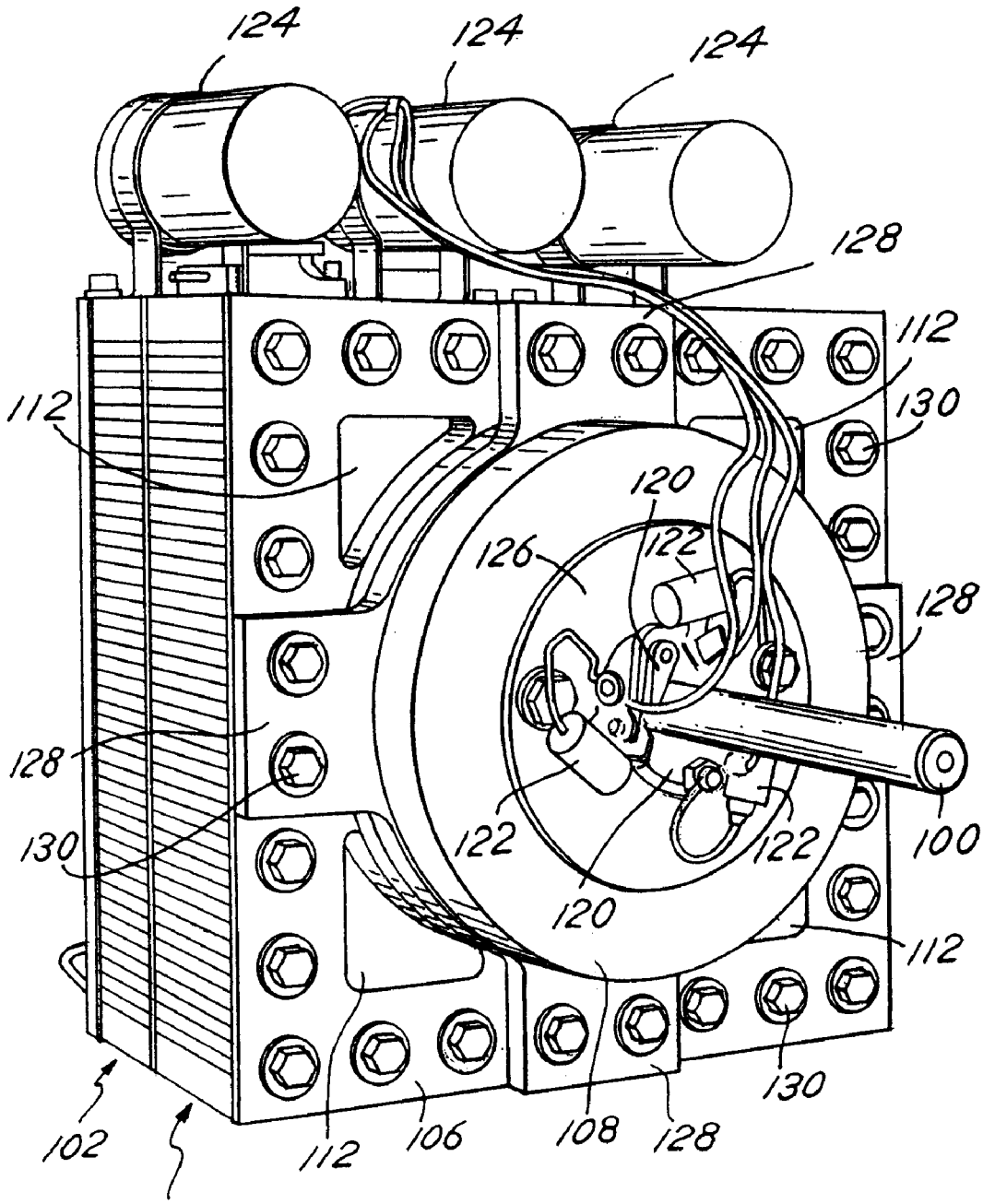
FIG. 1 is a front view of a radial combustion motor in accordance with an embodiment of the present invention.

The present invention can be more fully understood with reference to FIGS. 1–14. FIG. 1 is a front view of a radial combustion motor 100 in accordance with an embodiment of the present invention As shown in FIG. 1, motor 100 includes a compression section 104, a combustion section 102 disposed adjacent to compression section 104, and a precompression chamber 108 disposed adjacent to compression section 104 and on the opposite side of compression section 104 from combustion section 102. Disposed between precompression chamber 108 and compression section 104, and affixed to each of precompression chamber 108 and compression section 104, is a precompression chamber plate 106. Disposed on the opposite side of precompression chamber 108 from precompression chamber plate 106, and attached to precompression chamber 108, is an adjustable switch plate 126. Motor 100 further includes a shaft 110 that extends through a length of the motor and that is mechanically coupled to each of a compression rotor (not shown) included in compression section 104 and a combustion rotor (not shown) included in combustion section 102.

Motor 100 further includes multiple, preferably three, ignition controllers that each include a latch 120 coupled to a switching device 122. Each switching device 122 is in turn electrically coupled to one of multiple voltage sources 124, such as a battery, and each voltage source 124 is further coupled to one of multiple fuel ignition devices as is described below with reference to FIG. 3. Each latch 120 and switching device 122 is mechanically coupled to switch plate 126. Further, reach latch 120 is disposed in an approximately tangential plane to shaft 110 and in contact with shaft 110.

Figure 2:
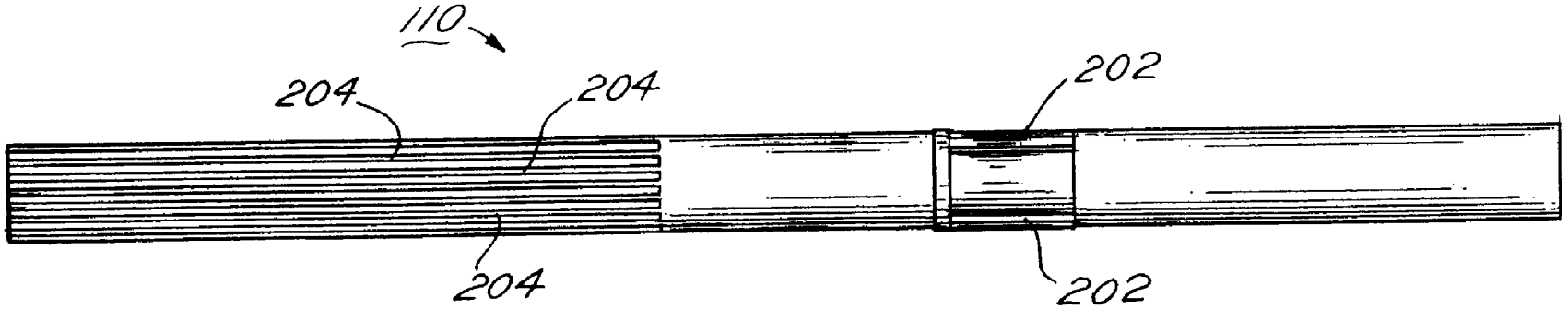
FIG. 2 is an illustration of a shaft of FIG. 1 in accordance with an embodiment of the present invention.

FIG. 2 is and illustration of shaft 110 in accordance with an embodiment of the present invention. As shown in FIG. 2, shaft 110 includes multiple channels 202 that are circumferentially distributed about a central area of shaft 110 and that interface with each of the multiple latches 120 when shaft 110 is rotating. As shaft 110 rotates, each channel of the multiple channels 202 causes a tripping of each latch 120, thereby causing an enabling of a switching device 122 coupled to the latch. An enabling of a switching device 122 in turn causes a voltage source 124 coupled to the switching device to convey a control signal to one of the multiple fuel ignition devices, such as a spark plug. Shaft 110 further includes multiple ridges 204 that are circumferentially distributed about a distal portion of shaft 110. Multiple ridges 204 provide a mechanism for mechanically coupling shaft 110 to each of the compression rotor and the combustion rotor. As described in greater detail below, latches 120, switching devices 122, voltage sources 124, and the multiple fuel ignition devices are designed to provide an ignition spark to a compressed fuel mixture that is contained in a combustion chamber of combustion section 102 in synchronization with the rotation of a combustion rotor rotatably disposed in the combustion chamber.

Those who are of ordinary skill in the art realize that there are other topologies that may be utilized for latches 120, switching devices 122, voltage sources 124, and the multiple fuel ignition devices, and further realize that there are other means of providing an ignition spark in synchronization with the rotation of the combustion rotor. For example, in an alternative embodiment of the present invention, the multiple voltage sources 124 may be replaced by a single voltage source, and switching devices 122 may be interposed between the single voltage source and each fuel ignition device instead of between latches 120 and the multiple voltage sources 124. Such other topologies and other means of providing a spark may be used herein without departing from the spirit and scope of the present invention.

Motor 100, as shown in FIG. 1, further includes multiple, preferably four, air intake apertures 112. Each of the multiple air intake apertures 112 extends the full length of motor 100 and allows for the passage of air through the motor to a carburetor located adjacent to a rear side of motor 100.

Figure 3:
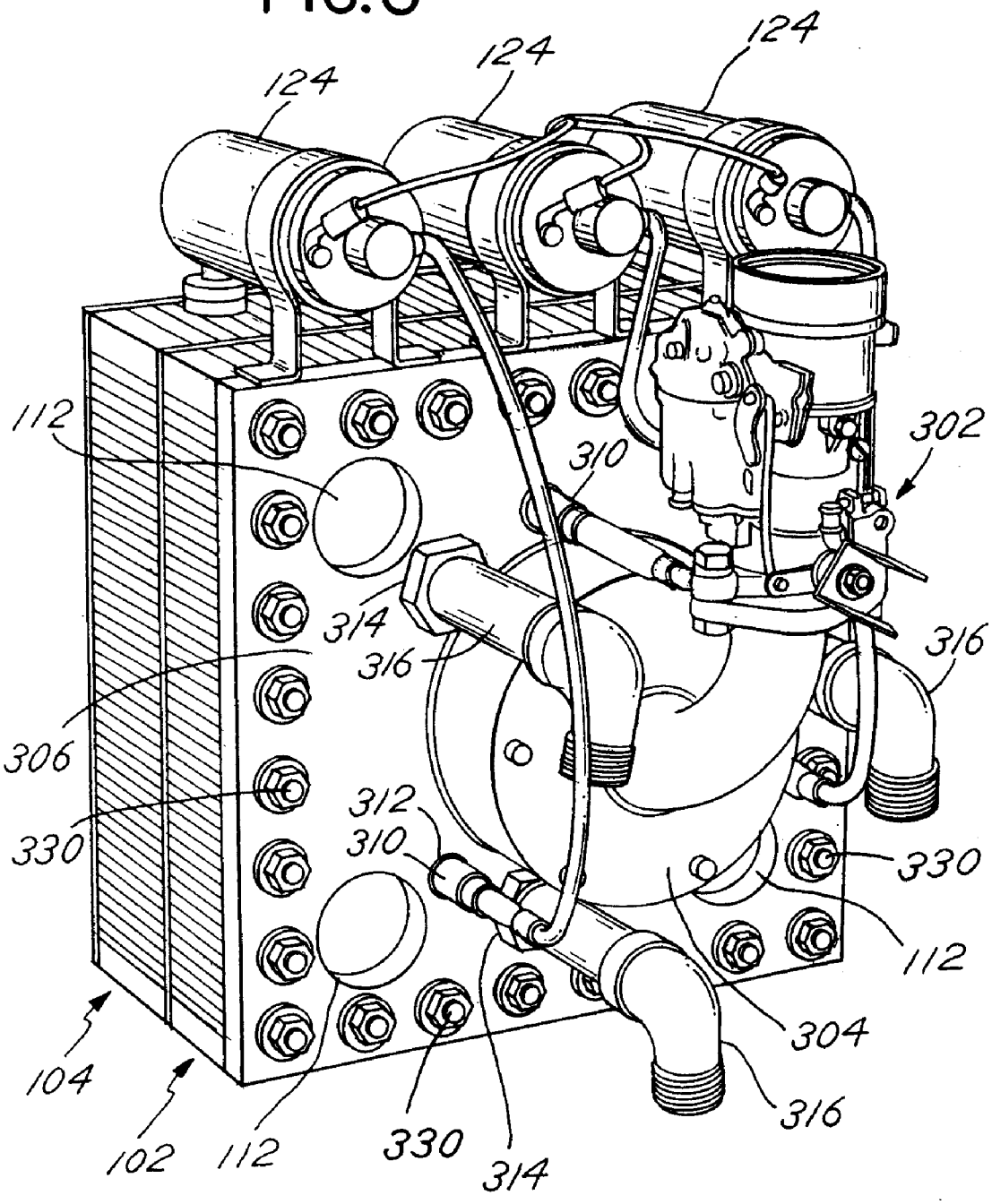
FIG. 3 is a rear view of a radial combustion motor in accordance with an embodiment of the present invention.

FIG. 3 is a rear view of radial combustion motor 100 in accordance with an embodiment of the present invention. Disposed on a rear side of combustion chamber 102 is a carburetor 302 that includes a carburetor connector (not shown) coupled to a mixing chamber 304. Mixing chamber 304 is further coupled to a carburetor plate 306 that is affixed to combustion section 102 and is disposed between carburetor 302 and combustion section 102. Preferably, carburetor plate 306 includes multiple air intake apertures 112 that are each coupled by an enclosed air passageway, such Was a pipe or a hose, to the carburetor connector. Each of the air intake apertures 112 provides air to carburetor 302 via the carburetor connector. The air is then mixed in mixing chamber 304 with a fuel, and preferably a lubricant, that is also provided to carburetor 302 to produce at fuel mixture. Mixing chamber 304 then provides the fuel mixture to compression section 102 for a precompression process that is described below.

As depicted in FIG. 3, motor 100 further includes multiple, preferably three, fuel ignition devices 310 that are each electrically coupled to a respective voltage source of the multiple voltage sources 124. Each of the multiple fuel ignition devices 310 is disposed in one of multiple, preferably three, ignition apertures 312 in carburetor plate 306. A voltage source 124 supplies a control signal to a respective fuel ignition device 310, which control signal causes the fuel ignition device to ignite a compressed fuel mixture contained in a sub-chamber of the combustion chamber of combustion section 102. As is described in greater detail below, ignition of the compressed fuel mixture imparts a torque on the combustion rotor included in combustion section 102, and thereby imparts a torque on shaft 110 and on the compression rotor, causing a rotation of each of the combustion rotor, shaft 110, and the compression rotor. Carburetor plate 306 further includes multiple, preferably three, exhaust apertures 314 that are each coupled to an exhaust pipe 316 and that are each aligned with a sub-chamber of the combustion chamber of combustion section 102. After the compressed fuel mixture contained in a sub-chamber of the combustion chamber is ignited by a fuel ignition device 310, the resulting exhaust escapes the sub-chamber via a respective exhaust aperture 314 and exhaust pipe 316.

Figure 4:
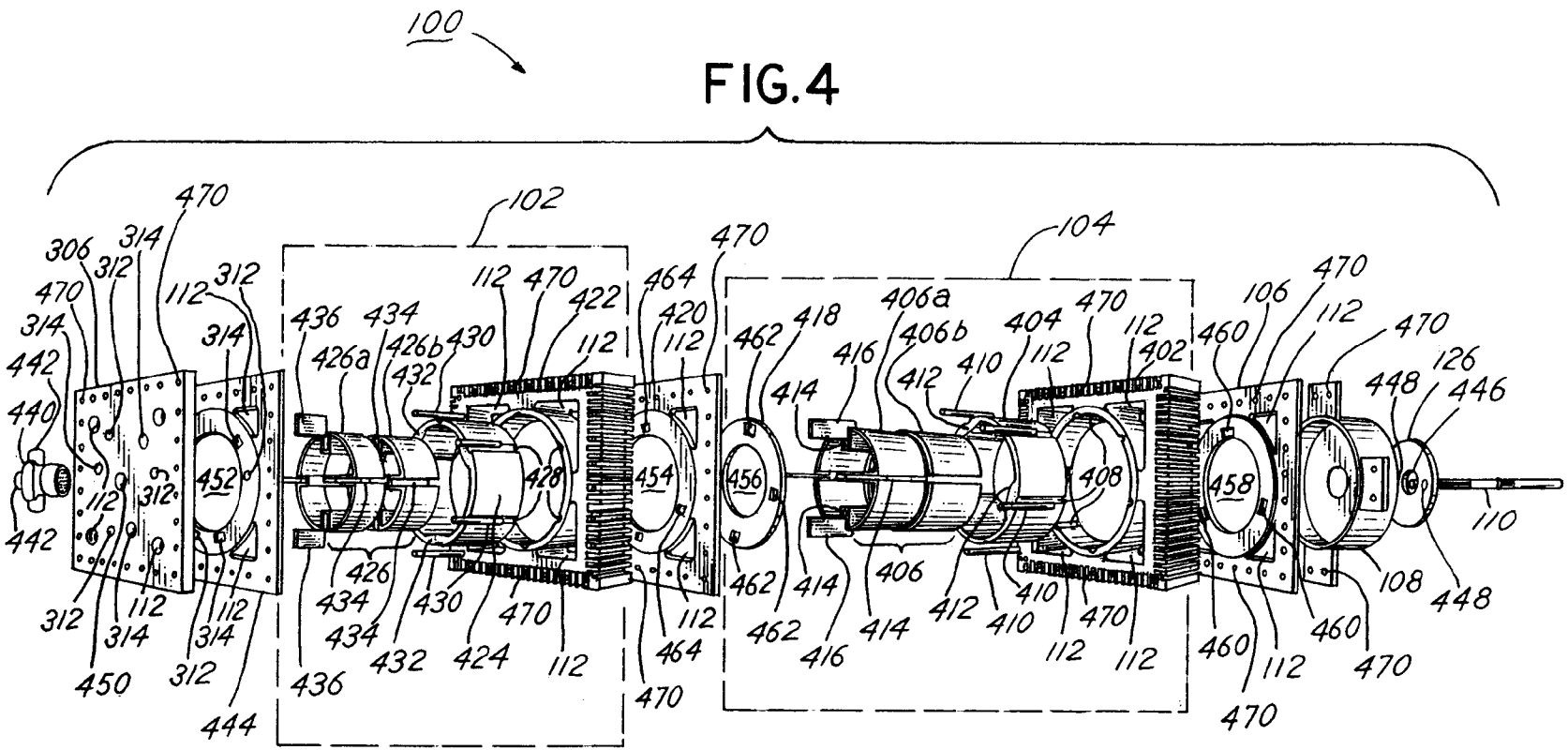
FIG. 4 is an exploded assembly drawing of a radial combustion motor in accordance with an embodiment of the present invention.

FIG. 4 is an exploded assembly drawing of radial combustion motor 100 in accordance with an embodiment of the present invention. As depicted in FIG. 4, compression section 104 of radial combustion motor 100 includes a compression block 402 that houses a substantially cylindrical compression chambers 404, which compression chamber is disposed in a fixed position inside of the compression block. Compression chamber 404 in turn houses a substantially cylindrical compression rotor 406 that is rotatably disposed inside of the compression chamber. Compression block 402 further includes multiple, preferably four, air intake apertures 112 that each allows air to flow through the compression block.

An inner wall of compression block 402 and an outer wall of compression chamber 404 each includes multiple locking pin slots 408 for receiving one of multiple locking pins 410. Each locking pin slot 408 of the inner wall of compression block 402 aligns with a corresponding locking pin slot 408 of the outer wall of compression chamber 404. A locking pin of the multiple locking pins 410 is inserted into each locking pin slot 408 of compression chamber 404 and a corresponding locking pin slot 408 of compression block 402 and thereby locks compression chamber 404 into a fixed position relative to compression block 402.

An inner wall of compression chamber 404 includes multiple, preferably three, ridges 412 that each extend approximately a length of the compression chamber. Preferably, the multiple ridges 412 are approximately equally spaced apart around a circumference of the inner wall of compression chamber 404. Compression rotor 406, in combination with the multiple ridges 412, divides an interior of compression chamber 404 into multiple sub-chambers, as is described below in greater detail with reference to FIG. 5. Each sub-chamber of the multiple sub-chambers is defined by the inner wall of compression chamber 404, compression rotor 406, and two of the multiple ridges 412.

Compression rotor 406 includes multiple sealing blade slots 414 for receiving one of multiple, generally rectangular, sealing blades 416. The multiple sealing blade slots 414 are approximately evenly spaced apart in terms of angular distance around the circumference of rotor 406. Each of the multiple sealing blade slots 414 is positioned in an outer surface of compression rotor 406, is approximately radially oriented, and extends a length of the rotor. Each sealing blade of the multiple seal blades 416 is slidably received in one of the multiple sealing blade slots 414. When compression rotor 406 rotates inside of compression chamber 408, each sealing blade 416 slides radially out of the sealing blade's respective sealing blade slot 414 until stopped by the inner wall of compression chamber 404. An outer edge of each sealing blade 416 remains slidably engaged with the inner wall of compression chamber 404 as compression rotor 406 rotates and thereby subdivides each sub-chamber of compression chamber 404 into two sections that are sealed off from each other by the sealing blade. The multiple ridges 412 of the inner wall of compression chamber 404 cause each sealing blade 416 to radially reciprocate in and out of the sealing blade's respective sealing blade slot 414 as the compression rotor 406 rotates.

Compression rotor 406 further includes a transfer ring 418 that is affixed to the compression rotor. In an alternative embodiment of the present invention transfer ring 418 may be affixed to combustion rotor 424. As is described in greater detail below, a fuel aperture 456 in transfer ring 418 facilitates a transfer of a fuel mixture from combustion section 102 to compression rotor 406, and multiple fuel return apertures 462 in transfer ring 418 each facilitates a transfer of a compressed fuel mixture from a sub-chamber of compression chamber 404 to a sub-chamber of combustion chamber 424. Also as is described in greater detail below, transfer ring 418 seals closed a sub-chamber of combustion chamber 424 during an ignition of a compressed fuel mixture contained in the sub-chamber.

Figure 5:
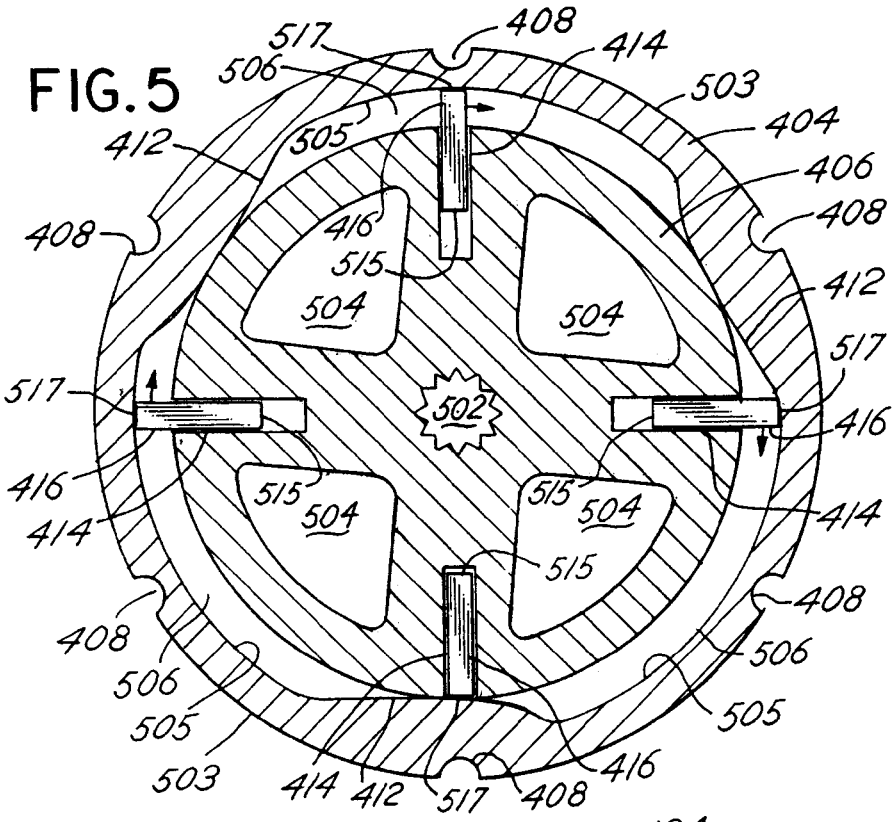
FIG. 5 is a cross-sectional illustration of a compression rotor of FIG. 4 disposed within in a compression chamber of FIG. 4 in accordance with an embodiment of the present invention.

FIG. 5 is a cross-sectional illustration of a rotating compression rotor 406 disposed within compression chamber 404 in accordance with an embodiment of the present invention. As shown in FIG. 5, compression chamber 404 includes an inner wall 505 having multiple ridges 412 and an outer wall 503 having multiple locking pin slots 408. Compression rotor 406 includes multiple sealing blade slots 414, in each of which is disposed one of multiple sealing blades 416. Each sealing blade 416 has an inner edge 515 and an outer edge 517. Compression rotor 406 further includes a shaft aperture 502 and multiple, preferably four, fuel apertures 504. A circumference of shaft aperture 502 is ridged for the insertion of the correspondingly ridged shaft 110, thereby,providing a mechanical coupling between shaft 110 and compression rotor 406. The mechanical coupling allows a torque applied to shaft 110 to be translated to a torque applied to compression rotor 406, thereby allowing a rotation of shaft 110 to cause a corresponding rotation in compression rotor 406.

As is further shown in FIG. 5, the positioning of compression rotor 406 in compression chamber 404 divides the compression chamber into multiple, preferably three, approximately evenly spaced apart (i.e., in terms of angular distance) sub-chambers 506, wherein each sub-chamber of the multiple sub-chambers 506 spans an approximately equal angular distance. When compression rotor 406 is rotating in compression chamber 404, each of the multiple sealing blades 416 experiences an outward (i.e., centrifugal) force compelling each sealing blade 416 to slide out of the sealing blade's corresponding sealing blade slot 414 until stopped by, and slidingly engaged with, the inner wall 505 of compression chamber 406. As a sealing blade 416 that is slidingly engaged with the inner wall 505 of compression chamber 406 passes through a sub-chamber 506 of the compression chamber, the sealing blade 416 sub-divides the sub-chamber into two sections, a first section in front of the sealing blade and a second section behind the sealing blade. As is described in greater detail below passage of the sealing blade through the sub-chamber compresses, in the first section, any gas that may be contained in the first section.

Furthermore, as can be seen in FIG. 5 and as is further described below with reference to FIGS. 12A–12L the orientation of the multiple sealing blades 414 with respect to the multiple ridges 412 of the inner wall 505 of compression chamber 404 is such that each sub-chamber 506 is in a different stage of compression at any particular time in the operation of motor 100. As is described in greater detail below, a precompressed fuel mixture compressed in a sub-chamber 506 of compression chamber 404 is transferred from sub-chamber 506 to a sub-chamber of combustion chamber 424 when a sealing blade 416 nears the end of its transition through sub-chamber 506. Preferably, motor 100 is designed so that only one sub-chamber 506 transfers a compressed fuel mixture to combustion chamber 424 at any particular time and that each of the multiple sub-chambers 506 sequentially transfers a compressed fuel mixture to combustion chamber 424 in synchronization with the rotation of compression rotor 406, shaft 110, and a combustion rotor 426.

Referring again to FIG. 4, combustion section 102 of radial combustion motor 100 is shown to include a combustion block 422 that houses a substantially cylindrical combustion chamber 424 that is disposed in a fixed position inside of the combustion block. Combustion chamber 424 in turn houses a substantially cylindrical combustion rotor 426 that is rotatably disposed inside of the combustion chamber. Combustion block 422 further includes multiple, preferably four, air intake apertures 112 that each allows air to flow through the combustion block.

An inner wall of combustion block 422 and an outer wall of combustion chamber 424 each includes multiple locking pin slots 428 for receiving one of multiple locking pins 430. Each locking pin slot 428 of the inner wall of combustion block 422 aligns with a corresponding locking pin slot 428 of the outer wall of combustion chamber 424. A locking pin of the multiple locking pins 430 is inserted into each locking pin slot 428 of the combustion chamber and a corresponding locking pin slot 428 of the combustion block and thereby locks combustion chamber 424 into affixed position relative to combustion block 422.

An inner wall of combustion chamber 424 includes multiple, preferably three, ridges 432 that each extend approximately a length of the combustion chamber. Preferably, the multiple ridges 432 are approximately equally spaced apart around a circumference of the inner wall of combustion chamber 424. Combustion rotor 426, in combination with the multiple ridges 432, divides an interior of the combustion chamber 424 into a plurality of sub-chambers. Each sub-chamber is defined by the inner wall of combustion chamber 424, combustion rotor 426, and two of the multiple ridges 432.

Similar to compression rotor 406, combustion rotor 426 includes multiple sealing blade slots 434 for receiving one of multiple, generally rectangular, sealing blades 436. The multiple sealing blade slots 434 are approximately evenly spaced apart, in terms of angular distance, around the circumference of rotor 426. Each of the multiple sealing blade slots 434 is positioned in an outer surface of combustion rotor 426, is approximately radially oriented, and extends a length of the rotor. Each sealing blade of the multiple seal blades 436 is slidably received in one of the multiple sealing blade slots 434. When combustion rotor 426 rotates inside of combustion chamber 424, each sealing blade 436 slides radially out of the sealing blade's respective sealing blade slot 434 until stopped by the inner wall of combustion chamber 424. An outer edge of each sealing blade 436 remains slidably engaged with the inner wall of combustion chamber 424 as combustion rotor 426 rotates and thereby subdivides each sub-chamber of the combustion chamber into two sections. The multiple ridges 432 of the inner wall of compression chamber 424 cause each sealing blade 436 to radially reciprocate in and out of the sealing blade's respective sealing blade slot 434 as compression rotor 426 rotates in combustion chamber 424.

Figure 6:
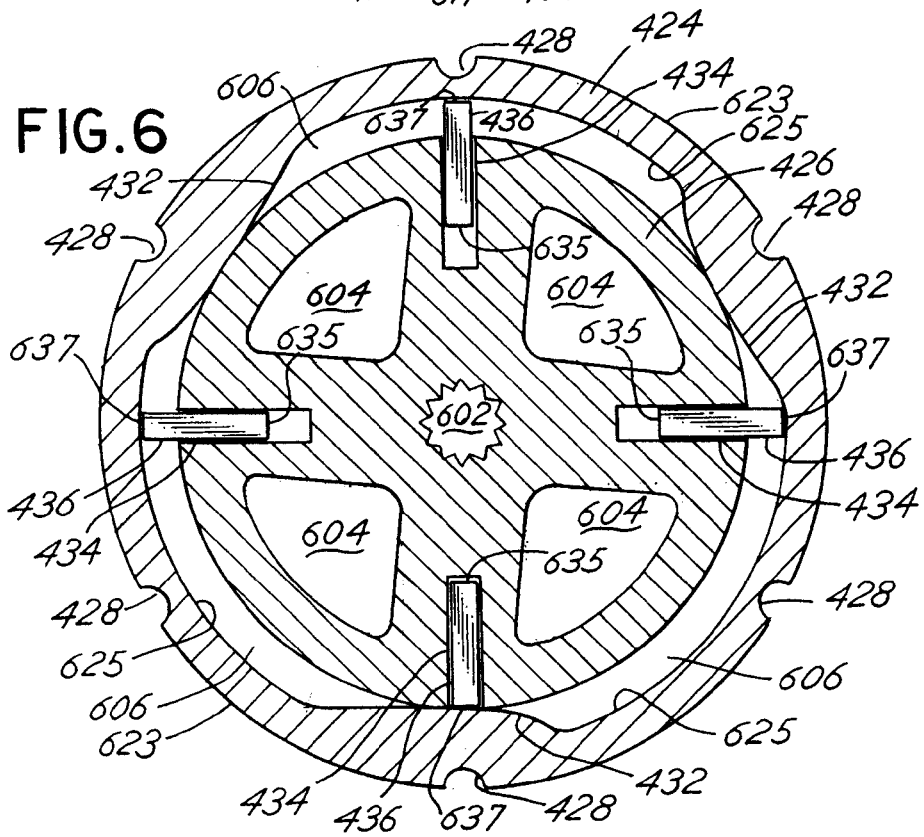
FIG. 6 is a cross-sectional illustration of a combustion rotor of FIG. 4 disposed within a combustion chamber of FIG. 4 in accordance with an embodiment of the present invention.

FIG. 6 is a cross-sectional illustration of a rotating combustion rotor 426 disposed within combustion chamber 424 in accordance with an embodiment of the present invention. As shown in FIG. 6, combustion chamber 424 includes an inner wall 625 having multiple ridges 432 and an outer wall 623 having multiple locking pin slots 428. Combustion rotor 426 includes multiple sealing blade slots 434, in each of which is disposed one of multiple sealing blades 436. Each sealing blade 436 has an inner edge 635 and an outer edge 637. Similar to compression rotor 406 as described in FIG. 5, combustion rotor 426 further includes a shaft aperture 602 and multiple, preferably four, fuel apertures 604. A circumference of shaft aperture 602 is ridged for the insertion of the correspondingly ridged shaft 110, thereby providing a mechanical coupling between shaft 110 and combustion rotor 426. The mechanical coupling allows a torque applied to combustion rotor 426 to be translated to a torque applied to shaft 110, thereby allowing a rotation of combustion rotor 426 to cause a corresponding rotation of shaft 110.

As is further shown in FIG. 6 and similar to compression rotor 406 as described with reference to FIG. 5 the positioning of combustion rotor 426 in combustion chamber 424 divides the combustion chamber into multiple, preferably three, approximately evenly spaced apart (i.e., in terms of angular distance) sub-chambers 606. When rotor 426 is rotating in combustion chamber 424, each of the multiple sealing blades 436 experiences an outward (i.e., centrifugal) force that compels each sealing blade 436 to slide out of the sealing blade's corresponding sealing blade slot 434 until stopped by, and slidingly engaged with, the inner wall 625 of combustion chamber 426. As a sealing blade 436 that is slidingly engaged with the inner wall 625 of combustion chamber 426 passes through a sub-chamber 606 of the combustion chamber, the sealing blade sub-divides the sub-chamber into two sections, a first section in front of the sealing blade and a second section behind the sealing blade. As is described in greater detail below, an ignition of a compressed fuel mixture in the second section (i.e., the section behind the sealing blade) imparts a forward force on the sealing blade, and thereby on combustion rotor 426 and on shaft 110 that is coupled to the rotor, that propels the sealing blade, combustion rotor, and shaft in a circular motion around the interior of combustion chamber 424.

Radial combustion motor 100 is designed so that ignition of a compressed fuel mixture contained in a sub-chamber 606 of combustion section 102 occurs in only one sub-chamber 606 at a time, and that ignition occurs in each of the multiple sub-chambers 606 in a sequential fashion that is in synchronization with the rotation of compression rotor 406, shaft 110, and a combustion rotor 426. An ignition of a combustible fuel in each of the multiple sub-chambers 606 in a sequential fashion as combustion rotor 426 rotates permits as many as twelve power strokes per complete, 360° rotation of the combustion rotor and of shaft 110, as is described in greater detail below with reference to FIGS. 11A–11L.

Those who are of ordinary skill in the art realize that there are a nearly unlimited number of combinations of a number of sub-chambers 506, 606 and a number of respective sealing blades 416, 436 that may be implemented in each chamber 404, 424 without departing from the spirit and scope of the present invention. For example, the number of ridges on an interior wall of each of compression chamber 404 and combustion chamber 424 may be a number different than three resulting in a corresponding change in a number of sub-chambers 506, 606 included in each chamber 404, 424. By way of another example, each sub-chamber 506, 606 respectively included in each chamber 404, 424 may be a different size, that is, span a different angular distance, than the other sub-chambers in the chamber or be of a different angular distance from the other sub-chambers. In still another example, a number of sealing blades 416, 436 and corresponding, sealing blade slots 414, 434 included in each chamber 404, 424 may be a number other than four. Furthermore, the sealing blade slots 414, 434 and corresponding sealing blades 416, 436 need not be evenly distributed around the circumference of their respective rotors 406. 426, with the result that each of the multiple power strokes per rotation of combustion rotor 426 need not be evenly spaced apart in time. The use of three approximately evenly spaced apart ridges and three approximately evenly spaced apart sub-chambers four approximately evenly spaced apart scaling blade slots, and four approximately evenly spaced apart sealing blades in each of compression section 104 and combustion section 102, as shown in FIGS. 4, 5, 6, 7A, 7B, 8A, and 8B, and the number and angular distribution of corresponding fuel apertures 504, 604, fuel return apertures 460, 462, 464, exhaust apertures 314, and ignition apertures 312, is merely meant to illustrate the principles of the present invention is not intended to limit the present invention in any way.

Preferably, each of compression rotor 406 and combustion rotor 426 is a multi-layered mechanical component. A first, outer layer 406*a,* 426*a* of the multiple layers of each rotor 406, 426 is preferably constructed of a metal alloy, such as a carbon alloy, that is harder than a metallic material of a second, inner layer 406*b,* 426*b* of the multiple layers of each rotor. Alternatively, outer layers 406*a,* 426*a* may each be a sleeve that surrounds a respective inner layer 406*b,* 426*b,* wherein the sleeve is composed of a first metallic material and the inner layer is composed of a second metallic material, and wherein the first metallic material is harder than the second metallic material. By constructing each of rotors 406 and 426 of multiple layers wherein a respective outer layer 406*a,* 426*a* is of a harder metallic material than a respective inner layer 406*b,* 426*b,* each rotor 406, 426 presents an outer surface that is able to withstand the wear and tear of the friction generated by the movement of the multiple sealing blades 416, 436 and by a rubbing of the rotor 406, 426 against an inner wall of a respective compression chamber 404 and combustion chamber 424, while minimizing the material cost of each rotor 406, 426.

Referring again to FIG. 4, a fixed transfer plate 420 is disposed between compression section 104 and combustion section 102. As is described in greater detail below, fixed transfer plate 420 provides for a transfer of intake air from compression section 104 to combustion section 102, a transfer of a fuel mixture from combustion section 102 to compression section 104, and a transfer of a compressed fuel mixture from compression section 104 to combustion section 102. Disposed on the opposite side of compression section 104 from fixed transfer plate 420 is precompression chamber 108, and disposed between precompression chamber 108 and compression section 104 is precompression plate 106 that includes multiple, preferably four, air intake apertures 112.

Disposed on the opposite side of combustion section 102 from fixed transfer plate 420 is the carburetor 302, which carburetor preferably includes mixing chamber 304 (not shown) and a carburetor connector 440. Carburetor connector 440 includes multiple, preferably four, air intake ports 442 that are each coupled to one of the multiple air intake apertures 112 of carburetor plate 306 by an enclosed air passageway (not shown), such as a hose or a pipe. Alternatively, one or more of the air intake ports 442 may be coupled to a fuel source for the input of fuel into carburetor 302 and/or to a lubricant source for the input of a lubricant into carburetor 302. As shown in both FIGS. 3 and 4, disposed between carburetor 302 and combustion section 102 is carburetor plate 306, which carburetor plate is affixed to combustion block 424 and to which is affixed mixing chamber 304. Included in carburetor plate 306 are multiple, preferably four, air intake apertures 112, multiple, preferably three, ignition apertures 312, and multiple, preferably three, exhaust apertures 314, wherein each ignition aperture 312 and each exhaust aperture 314 is associated with a corresponding combustion sub-chamber 606.

FIG. 4 further depicts an ignition and exhaust plate 444 disposed between, and affixed to each of, combustion section 102 and carburetor plate 306. In alternative embodiments of the present invention ignition and exhaust plate 444 may be included in carburetor plate 306 or ignition and exhaust plate 444 may not be included in motor 100. Ignition and exhaust plate 444 includes multiple, preferably four, air intake apertures 112, multiple, preferably three, ignition apertures 312, and multiple, preferably three, exhaust apertures 314. Each of the multiple air intake apertures 112 multiple ignition apertures 312, and multiple exhaust apertures 314 of ignition and exhaust plate 444 is respectively aligned with a corresponding air intake aperture 112, ignition aperture 312, and exhaust aperture 314 of carburetor plate 306. A fuel ignition device 310 is disposed in each pair of aligned ignition apertures 312 of ignition and exhaust plate 444 and carburetor late 306. The fuel ignition device 310 disposed in the ignition apertures 312 provides ignition energy, such as a spark, to a sub-chamber 606 of combustion chamber 424 and thereby ignites a compressed fuel mixture contained in the sub-chamber. The exhaust resulting from the ignition of the compressed fuel mixture then escapes the sub-chamber 606 via an aligned pair of exhaust apertures 314 of ignition and exhaust plate 444 and carburetor plate 306 and an exhaust pipe 316 (shown in FIG. 3) coupled to the exhaust aperture 314 of the carburetor plate 306.

FIG. 4 further depicts switch plate 126 disposed on an opposite side of precompresssion chamber 108 from precompresssion chamber plate 106. Switch plate 126 includes a shaft aperture 446 that allows shaft 110 to extend through the switch plate. Switch plate 126 further includes multiple adjustment apertures 448 that permit a rotational adjustment of the position of the switch plate relative to the multiple sub-chambers 606 of combustion chamber 424. By adjusting switch plate 126, the tripping of each of the multiple latches 120 attached to the switch plate may be synchronized with the rotation of combustion rotor 426, thereby optimizing the timing of the ignition of a compressed fuel mixture contained in a sub-chamber 606 of combustion chamber 424.

Preferably, a perimeter of each of carburetor plate 306, ignition and exhaust plate 444, combustion block 422, fixed transfer plate 420, compression block 402 and precompression chamber plate 106 includes multiple assembly apertures 470. In addition, precompression chamber 108 includes multiple attachment flanges 128 that each include multiple, preferably two, assembly apertures 470. These components 306, 444, 422, 420, 402, 106, and 108 are then affixed to each other by the alignment of each of the multiple assembly apertures in each of these components with a corresponding assembly aperture in each of the other components and the insertion of a bolt 130, as shown in FIG. 1, through each set of aligned apertures. Each bolt 130 is then secured in lace by a nut 330 that is fastened on a distal end of the bolt, as shown in FIG. 3. Switch plate 126 may be screwed or bolted to precompression chamber 108 after being properly aligned for proper synchronization of latches 120 and ignition devices 310 with the sub-chambers 606 off combustion chamber 426. Mixing chamber 304 is preferably bolted to carburetor plate 306. Transfer ring 418 is preferably screwed to compression rotor 406. The means by which the various components of radial combustion motor 100 are affixed to each other is not critical to the invention, and other means of securing one component to another will occur to those who are of ordinary skill in the art and may be used herein without departing from the spirit and scope of the present invention.

In general, a radial combustion motor 100 is provided that includes a combustion section 102 and a compression section 104. Each of combustion section 102 and compression section 104 includes a respective combustion block 422 and compression:block 402. Each of the combustion block 422 and compression block 402 houses a respective approximately cylindrical rotor 426, 406 that rotates in an approximately cylindrical chamber 424, 404. A respective inner wall 625, 505 of each of combustion chamber 424 and compression chamber 404 includes multiple, preferably three, ridges 432, 412 such that each chamber is divided into multiple sub-chambers 606, 506 when a respective rotor 426, 406 is positioned in the chamber. Each rotor 426, 406 includes multiple, preferably four, sealing blade slots 434, 404 that each extend the length of the rotor and that each slidably receives one of multiple, preferably four, sealing blades 436, 416. Rotation of each rotor 426, 406 causes each sealing blade 436, 416 to slide radially out of the blade's respective sealing blade slot 434, 404 until an outer edge 637, 517 of the sealing blade slidably engages a respective inner wall 625, 505 of the respective chamber 424, 404. Each sealing blade 436, 416 thereafter remains engaged with the respective inner wall 625, 505 for so long as the rotor rotates. As a sealing blade 436, 416 moves across a respective sub-chamber 606, 506, the sealing blade subdivides the sub-chamber into two sections, a first section in front of the sealing blade and a second section behind the sealing blade.

Radial combustion motor 100 further includes multiple air intake apertures 112 in each of precompression chamber plate 106, compression block 402, transfer plate 420, combustion block 422, ignition and exhaust plate 444, and carburetor plate 306 that together provide an air intake path from the front of motor 100 to carburetor 302. Each of carburetor plate 306, ignition and exhaust plate 444, transfer plate 420, transfer ring 418, and precompression chamber plate 106, further includes a respective fuel aperture 450, 452, 454, 456, and 458 that provides a path for a passage of a fuel mixture from carburetor 302 to precompression chamber 108. The fuel mixture passes through each of combustion section 102 and compression section 104 via multiple fuel apertures 604, 504 in each of rotors 426, 406.

The fuel mixture is compressed in precompression chamber 108 and then conveyed via the fuel return apertures 460 of precompression plate 106 to the sub-chambers 506 of compression chamber 406, where rotating sealing blades 416 further compress the fuel. The compressed fuel is then conveyed from each sub-chamber 506 of compression chamber 406 to one of the multiple sub-chambers 606 of combustion chamber 426 via the respective fuel return apertures 462, 464 of transfer ring 418 and fixed transfer plate 420. The compressed fuel is ignited in each sub, chamber 606 by an ignition device 310. Combustion of the compressed fuel produces a force that is applied to a sealing blade 436 positioned in the sub-chamber 606, thereby causing combustion rotor 426, and a shaft 110 coupled to the combustion rotor, to rotate. Rotation of shaft 110 in turn imparts a torque on compression rotor 406 and on any mechanical device coupled to the shaft.

In an alternative embodiment of the present invention, a "fuel injection" embodiment, fuel is not mixed with the air and lubricant until the air arrives at a sub-chamber 606 of combustion chamber 424. In the fuel injection embodiment, only lubricant is mixed with air in carburetor 302, or alternatively the lubricant and carburetor 302 are dispensed with altogether. In the fuel injection embodiment, intake air, or a mixture of intake air and a lubricant, is conveyed from the rear side of motor 100 to precompression chamber 108 via fuel apertures 504 and 604, similar to the above described conveyance of the fuel mixture. Precompression chamber 108 then conveys the received air, or air and lubricant mixture, to compression chamber 404 wherein the air or air and lubricant mixture is compressed in a sub-chamber 506 of compression chamber 404, again by a process similar to the process described above with respect to the fuel mixture. The compressed the air, or air and lubricant mixture, is then conveyed from the compression chamber sub-chamber 506 to a sub-chamber 606 of combustion chamber 424 by a process similar to the process described above with respect to the fuel mixture.

In the fuel injections embodiment, each of carburetor plate 306 and ignition and exhaust plate 444 further includes multiple, preferably three, fuel injection apertures. Each fuel injection aperture of carburetor plate 306 is aligned with a corresponding fuel injection aperture of ignition and exhaust plate 444, and is further aligned with a sub-chamber 606 of combustion chamber 424. Positioned in each fuel injection aperture of carburetor plate 306 and corresponding fuel injection aperture of ignition and exhaust plate 444 is a fuel injector that provides fuel to the corresponding sub-chamber 606. Fuel injectors are well known in the art and will not be described in greater detail herein. In accompaniment to the conveyance of the compressed air or air and lubricant mixture by a compression chamber sub-chamber 506 to the corresponding sub-chamber 606, the fuel injector injects a combustible fuel, such as gasoline, diesel oil, or hydrogen, into the portion of the sub-chamber 606 containing the compressed air or air and lubricant mixture to produce a fuel mixture.

The fuel injection embodiment of motor 100 further includes an injection controller that controls the injection of fuel by each of the multiple fuel injection devices into a corresponding sub-chamber 606 of combustion chamber 424. In one embodiment, the radial combustion motor includes a single voltage source instead of the multiple voltage sources 124. The single voltage source is coupled to a microprocessor, which microprocessor is further coupled to each of switching devices 122, to each of the multiple fuel ignition devices 310, and to each of the multiple fuel injection devices. As described above, a rotation of shaft 110 causes a channel of multiple channels 202 of shaft 110 to trip a latch 120 coupled to a switching device 122. The tripping of the latch causes an enabling of the switching device, in turn causing the microprocessor coupled to the switching device to convey control signals to each of a fuel injection device and an ignition device 310 associated with a sub-chamber 606 of combustion chamber 424 that has just received compressed air, or a compressed air and lubricant mixture, from a sub-chamber 506 of compression chamber 404. The control signals cause the fuel injection device to inject fuel into the associated sub-chamber 606 to produce a mixture of fuel and compressed air, or fuel and compressed air and lubricant and further cause the ignition device 310 to ignite the mixture, producing a force that is applied to a sealing blade 436 positioned in the sub-chamber 606 and thereby causing combustion rotor 426 and shaft 110 to rotate.

By using a system of rotors, sealing blades, and apertures, radial combustion motor 100 is of a greatly reduced complexity relative to the combustion motors of the prior art. Radial combustion motor 100 has no pistons, valves, or connector rods. The motor uses centrifugal force generated by a rotating rotor 406, 426 to cause the sealing blades 416, 436 to seal off compression and combustion sub-chambers 506, 606 and uses a ridged shaft 110 that is inserted into a correspondingly ridged aperture 502, 602 in each rotor 406, 526 to provide a mechanical coupling of the rotors to the shaft. Since motor 100 has few moving parts, the motor is easy and economical to maintain and repair. Radial combustion motor 100 also includes multiple, preferably three, sub-chambers in the combustion chamber, which allows for multiple power strokes per rotation of shaft 110 and a low size-to-power ratio.

A more detailed description of the operation of radial combustion motor 100 is as follows. Each intake air aperture 112 of precompression chamber plate 106 is aligned with a corresponding air intake aperture 112 of each of compression block 402, transfer plate 420, combustion block, 422, ignition and exhaust plate 444, and carburetor plate 306. In turn, each air intake aperture 112 of carburetor plate 306 is coupled to an air intake port 442 of carburetor connector 440 via an enclosed air passageway, such as a pipe or a hose. Carburetor 302 receives air via the air intake apertures 112 of each of compression block 402, transfer plate 420, combustion block 422, ignition and exhaust plate 444, and carburetor plate 306, and further receives fuel such as gasoline, although any type of combustible fuel may be used, from a fuel source (not shown) coupled to carburetor 302 via a carburetor fuel source connector (not shown). Connector 440 supplies the received air to mixing chamber 304, where the air is mixed with the fuel received from the fuel source to produce a fuel mixture. In a preferred embodiment, carburetor 302 further includes a lubricant connector (not shown) that receives a lubricant from a lubricant source and mixes the lubricant with the air and fuel to produce a fuel mixture.

The fuel mixture is subjected to two compression stages, a first, or precompression, stage and a second, or compression, stage. The precompression stage comprises a propelling of the fuel mixture from carburetor 302 at the rear of radial combustion motor 100 to precompression chamber 108 at the front of the motor, where the fuel mixture is collected and compressed to produce a precompressed fuel mixture. Precompression chamber 108 then conveys the precompressed fuel mixture to the sub-chambers 506 of compression chamber 404, where the precompressed fuel mixture is further compressed by the rotating sealing blades 416 associated with compression rotor 406.

In the first compression stage, mixing chamber 304 conveys the fuel mixture to combustion rotor 426 of combustion section 102 via a fuel aperture 450 included in carburetor plate 306 and a corresponding fuel aperture 452 included in ignition and exhaust plate 444. Fuel apertures 450 and 452 are aligned with each other and provide a path for the conveyance of the fuel mixture from mixing chamber 304 to combustion rotor 426.

FIG. 7A is an isometric profile of combustion rotor 426 and FIG. 7B is an isometric profile of a quarter section of combustion rotor 426 in accordance with an embodiment of the present invention. As illustrated by FIGS. 7A and 7B, each of the multiple fuel apertures 504 of combustion rotor 426 has an inlet 702 on a carburetor 302 side of the rotor and an outlet 704 on a compression section 104 side of the rotor. Inlet 702 and outlet 704 of each fuel aperture 504 are rotationally offset from each other in order to propel the fuel mixture received from carburetor 302 through the fuel aperture and to compression rotor 426. Carburetor 302 conveys the fuel mixture to each of the multiple fuel apertures 504 of combustion rotor 426. The rotation of combustion rotor 426 causes the fuel mixture conveyed to each aperture 504 to be propelled through the aperture to compression rotor 406. Disposed between combustion rotor 426 and compression rotor 406 are transfer plate 420 and transfer ring 418. Included in each of transfer plate 420 and transferring 418 is a respective fuel aperture 454 and 456 that allows the fuel mixture conveyed by combustion rotor 426 to pass through the transfer plate and transfer ring to compression rotor 406.

FIG. 8A is an isometric profile of compression rotor 406 and FIG. 8B is an isometric profile of a quarter section of compression rotor 406 in accordance with an embodiment of the present invention As shown in FIGS. 8A and 8B, and similar to combustion rotor 426 as described in FIGS. 7A and 7B, each of the multiple fuel apertures 604 of compression rotor 406 has an inlet 802 on a combustion section 102 side of the rotor and an outlet 804 on a precompression chamber 108 side of the rotor. Inlet 802 and outlet 804 of each fuel aperture 604 are rotationally offset from each other in order to propel the fuel mixture received from carburetor 302 through the fuel aperture and to precompression chamber 108. Combustion rotor 426 conveys the fuel mixture to each of the multiple fuel apertures 604 of combustion rotor 426. The rotation of compression rotor 406 causes the fuel mixture conveyed to each aperture 604 to be propelled through the aperture to precompression chamber 108 to produce a precompressed fuel mixture. Disposed between compression rotor 406 and precompression chamber 108 is precompression chamber plate 106. Precompression chamber plate 106 includes a fuel aperture 458 that allows the fuel mixture conveyed by compression rotor 406 to pass through the precompression chamber plate to precompression chamber 108. The propelling of the fuel mixture from carburetor 302 to precompression chamber 108 and a collecting of the fuel mixture in the precompression chamber results in a first stage of compression of the fuel mixture and produces the precompressed fuel mixture.

In the second stage of compression, precompression chamber 108 conveys the precompressed fuel mixture to one of multiple sub-chambers 506 of compression chamber 406 via one of multiple fuel return apertures 460 of precompression chamber plate 106. The precompressed fuel mixture is then further compressed in the sub-chamber 506.

Each of the multiple sub-chambers 506 of compression chamber 404 receives precompressed fuel mixture from precompression chamber 108 via one of multiple, preferably three, fuel return apertures 460 included in precompression chamber plate 106. Each of the multiple fuel return apertures 460 of precompression chamber plate 106 is fixed in position relative to each sub-chamber 506 of compression chamber 404 and is designed to provide a precompressed fuel mixture inlet for the corresponding sub-chamber. As a result, the number of fuel return apertures 460 preferably corresponds to the number (i.e., three) of sub-chambers 506 of compression chamber 404. The precompressed fuel mixture received by each sub-chamber 506 is then compressed by a sealing blade 416 that is moving through the sub-chamber pursuant to the rotation of the compression rotor 406 to produce a compressed fuel mixture. The compressed fuel mixture is then conveyed by the sub-chamber 506 to a sub-chamber 606 of combustion rotor 426 via one of multiple, preferably three, fuel return apertures 462, 464 respectively included in each of transfer ring 418 and transfer plate 420.

Figure 9A:
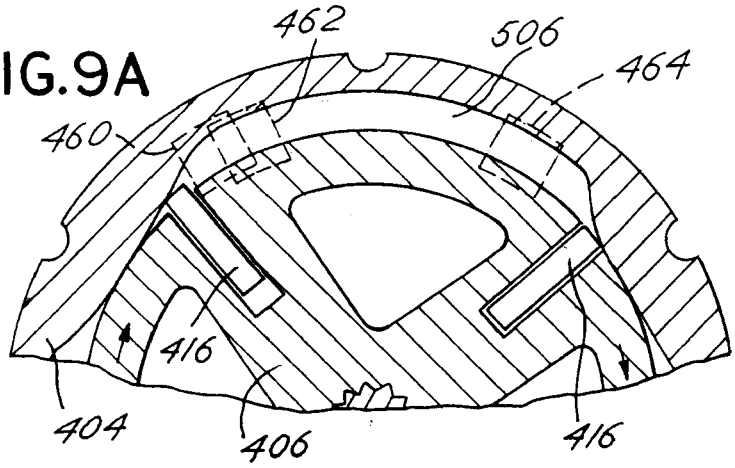
FIGS. 9A–9C are sectional views illustrating a compression of a fuel mixture by a compression rotor of FIG. 4 and associated sealing blades disposed within a compression chamber of FIG. 4 in accordance with an embodiment of the present invention.
Figure 9B:
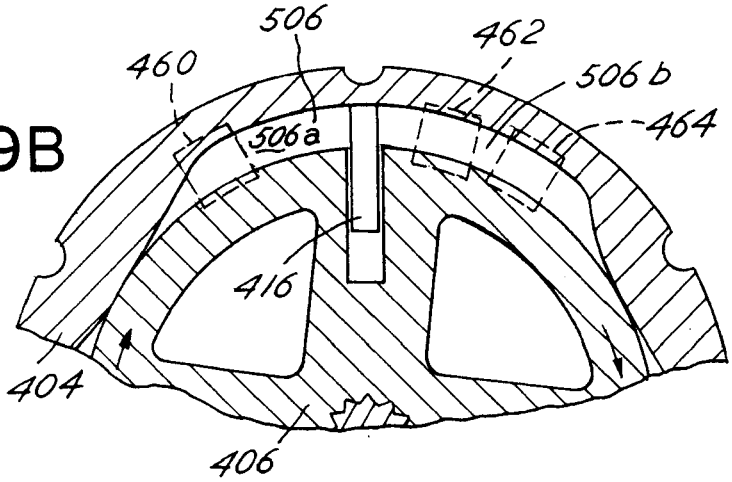
Figure 9C:
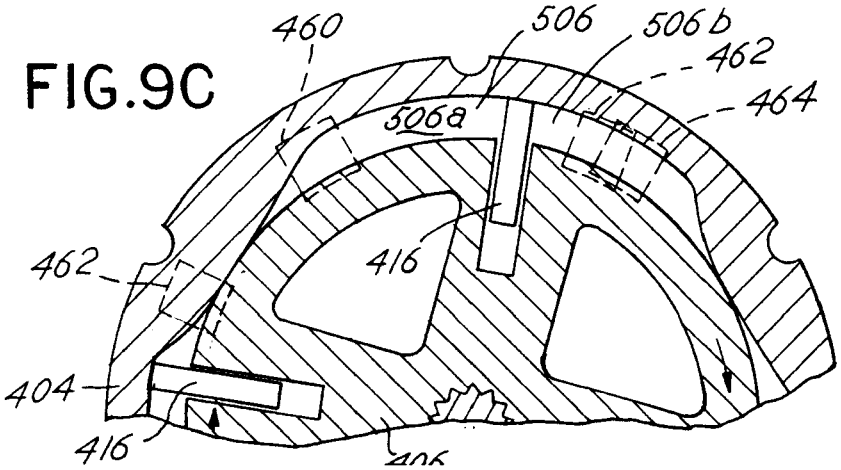

FIGS. 9A–9C illustrate a process whereby the precompressed fuel mixture is compressed in a sub-chamber of the multiple sub-chambers 506 of compression chamber 404 in accordance with an embodiment of the present invention. Each of FIGS. 9A–9C is an illustration of a section of compression chamber 404 and compression rotor 406 from the perspective of the rear of motor 100, with respect to which compression rotor 406 (as well as combustion rotor 426 and shaft 110) rotates gin a clockwise fashion. However, those who are of ordinary skill in the art realize that the direction of rotation is up to the designer of motor 100, and that compression rotor 406, combustion rotor 426, and shaft 110, along with the latches 120 coupled to switch plate 126, can each be designed for counterclockwise rotation with respect to a rear perspective of motor 100 without departing from the spirit and scope of the present invention.

In FIG. 9A, the precompressed fuel mixture is conveyed to sub-chamber 506 via a fuel return aperture 460 included in precompression chamber plate 106. The precompressed fuel mixture is unable to escape sub-chamber 506 via fuel return aperture 462 in transfer ring 418 because the aperture is blocked by transfer plate 420. The precompressed fuel mixture is also unable to escape sub-chamber 506 via fuel return aperture 464 in transfer plate 420 because the aperture is blocked by transfer ring 418.

As shown in FIGS. 9A–9C, each of the multiple fuel return apertures 460, 464 of precompression chamber plate 106 and transfer plate 420 are fixed in position relative to each sub-chamber 506 of compression chamber 404. Since transfer ring 418 is affixed to compression rotor 406, each of the multiple fuel return apertures 462 of transfer ring 418 moves across each sub-chamber 506 of compression chamber 404 in association with the rotation of compression rotor 406.

In FIG. 9B a sealing blade 416 has subdivided sub-chamber 506 into two sections, a first section **506*a* in front of the sealing blade and a second section 506*b* behind the sealing blade. The sealing blade seals the first section 506*b* off from the second section 506*a*. The precompressed fuel mixture that was contained in sub-chamber 506 in FIG. 9A is confined to section 506*b* and is compressed in section 506*b* by the movement of sealing blade 416 across sub-chamber 506 to produce a compressed fuel mixture. The fuel mixture in section 506*b* is unable to escape sub-chamber 506 since each of fuel return apertures 462 and 464 are not aligned with each other and are instead respectively blocked by fixed transfer plate 420 and transfer ring 418. In addition, a precompressed fuel mixture is entering section 506*a* from precompression chamber 108 via fuel return aperture 460**.

In FIG. 9C, fuel return aperture 462 is beginning to align with fuel return aperture 464. The precompressed fuel mixture contained in sub-chamber 506 in FIG. 9A and in section **506*b* in FIG. 9B has been compressed by sealing blade 416 and is conveyed by compression rotor 406 to combustion rotor 426 via fuel return apertures 462 and 464. Alignment of the two fuel return apertures 462, 464 allows the compressed fuel mixture to escape section 506*b* and to enter a sub-chamber 606 of combustion chamber 424. It can further be seen in FIG. 9C that section 506*a* is expanding and receiving additional precompressed fuel mixture, which precompressed fuel mixture will be compressed by a succeeding sealing blade of the multiple sealing blades 416 associated with rotor 426**.

Figure 10A:
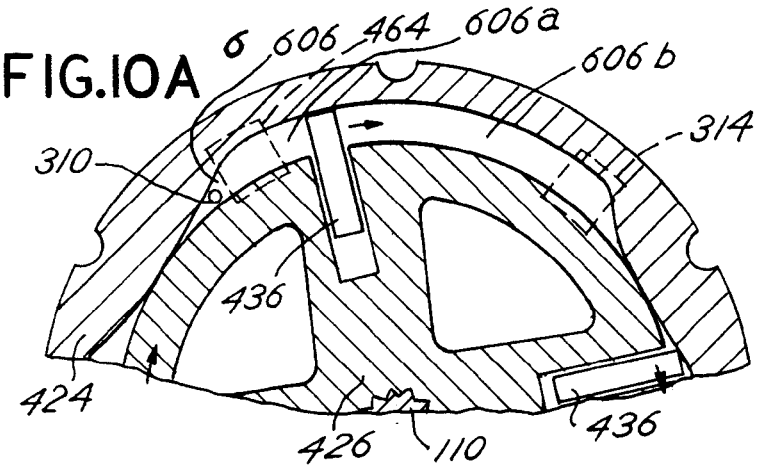
FIGS. 10A–10C are sectional views illustrating an imparting of a torque upon a combustion rotor of FIG. 4 disposed within a combustion chamber of FIG. 4 in accordance with an embodiment of the present invention.
Figure 10B:
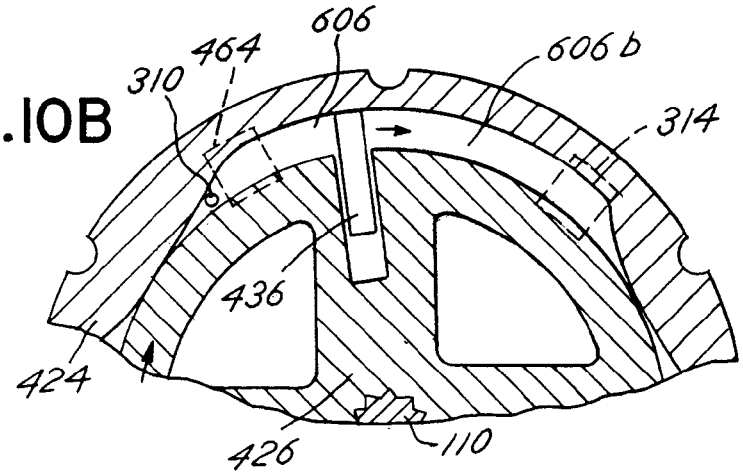
Figure 10C:
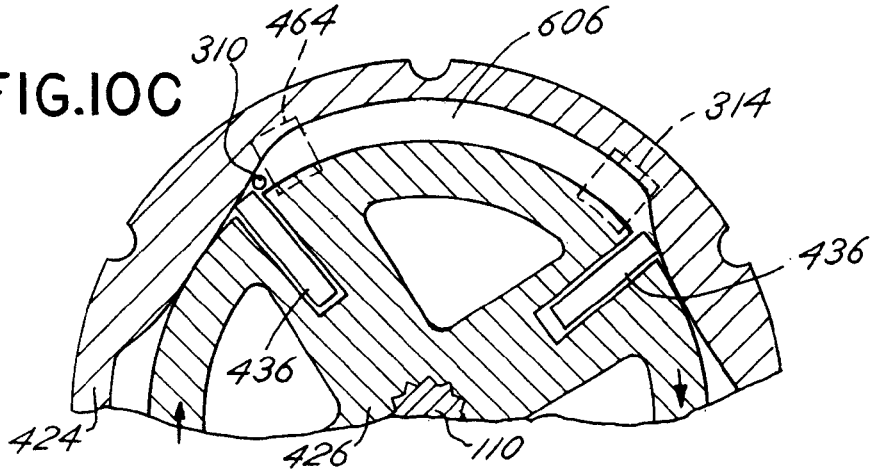

When the compressed fuel mixture produced in a sub-chamber 506 of compression chamber 404 is provided to sub-chamber 606 of combustion chamber 424, the compressed fuel mixture is ignited by an ignition device 310. The energy generated by the ignition of the compressed fuel mixture imparts a torque on combustion rotor 426, and thereby imparts a torque on shaft 110 and, in turn, on compression rotor 406, causing a rotation of each of combustion rotor 426, shaft 110, and compression rotor 406. The rotation of compression rotor 406 causes a compression of a precompressed fuel mixture in a sub-chamber 506 of compression chamber 404 as described above with respect to FIGS. 9A–9C. The rotation of shaft 110 also provides torque to any components external to motor 100 that are coupled to the shaft, such as a drivetrain for a motorized vehicle FIGS. 10A–10C illustrate a process whereby the compressed fuel mixture is ignited in a sub-chamber of the multiple sub-chambers 606 of combustion chamber 424 and causes the rotation of combustion rotor 426 and thereby of shaft 110 in accordance with an embodiment of the present invention. Similar to FIGS. 9A–9C, each of FIGS. 10A–10C is an illustration of a section of combustion chamber 424 and combustion rotor 426 from the perspective of the rear of motor 100, with respect to which combustion rotor 426 rotates in a clockwise fashion. For the purpose of assisting the reader in reviewing FIGS. 10A–10C and understanding the principles of the present invention, an orientation of combustion chamber 424 and combustion rotor 426 in FIGS. 10A–10C has been rotated counterclockwise approximately 60° with respect to the orientation of combustion chamber 424 and combustion rotor 426 in FIGS. 9A–9C. As a result, it should be noted that the fuel return aperture 464 shown in FIGS. 9A–9C is the same fuel return aperture as the fuel return aperture 464 shown in FIGS. 10A–10C.

In FIG. 10A, the compressed fuel mixture is conveyed to a sub-chamber 606 of combustion chamber 426 from a sub-chamber 506 of compression chamber 404 via fuel return apertures 462 and 464 of transfer ring 418 and transfer plate 420, respectively. Although not shown in FIG. 10A, fuel return aperture 462 is aligned with fuel return aperture 464 at this stage of operation of motor 100. The escape of the compressed fuel mixture from sub-chamber 506 via fuel return aperture 464 as described with reference to FIG. 9C is simultaneous in time to the input of the compressed fuel mixture into sub-chamber 606 of combustion chamber 424 via fuel return aperture 464 as described with reference to FIG. 10A. Sealing blade 436. divides sub-chamber 606 into a first section **606*b* in front of the sealing blade and a second section 606*a* behind the sealing blade. The compressed fuel mixture collects in the second section 606*a*** behind the sealing blade.

In FIG. 10B, the compressed fuel mixture contained in section **606*a* of sub-chamber 606** of combustion chamber 424 is ignited by fuel ignition device 310. Fuel ignition device 310 accesses sub-chamber 606 via an ignition aperture 312 in each of ignition and exhaust plate 444 and carburetor plate 306. The energy released by the ignition of the compressed fuel mixture is directed at sealing blade 436 and cannot escape sub-chamber 606 due to transfer ring 418, which is blocking fuel return aperture 464 (as fuel return aperture 462 in transferring 418 is no longer aligned, at this point in the operation of motor 100, with fuel return aperture 464). Also, the energy is unable to escape sub-chamber 606 via exhaust aperture 314 because sealing blade 436 seals off section 606*a* of sub-chamber 606, where ignition occurred, from section 606*b*, where exhaust aperture 314 is located. The released energy exerts a forward (i.e., clockwise) force on sealing blade 436 that in turn imparts a torque on combustion rotor 426, causing a clockwise rotation of combustion rotor 426. The torque applied to combustion rotor 426 results in the application of a torque to shaft 110, causing a clockwise rotation of shaft 110 which in turn applies a torque to land causes a clockwise rotation of, compression rotor 406.

As described above, a timing of the ignition of fuel ignition device 210 is synchronized with the rotation of combustion rotor 426 via switching plate 126 and the latches 120 attached to the switching plate. A position of switching plate 126 is adjusted so that fuel ignition device 210 is ignited after a compressed fuel mixture has been conveyed by sub-chamber 506 to sub-chamber 606 and transfer ring 418 is blocking an escape of energy from sub-chamber 606 via fuel return aperture 464.

In FIG. 1C, rotor 426 has rotated a sufficient clockwise distance that sealing blade 436 is no longer sealing off exhaust aperture 314 in ignition and exhaust plate 444 from the section of sub-chamber 606 where ignition occurred. The exhaust created by the ignition of the compressed fuel mixture in sub-chamber 606 is then able to escape the sub-chamber via exhaust aperture 314.

FIGS. 11A–11L illustrate a process whereby radial combustion motor 100 produces twelve power strokes in a single 360° rotation of combustion rotor 426 inside of combustion chamber 424. Each of FIGS. 11A–11L is a cross-sectional view of combustion chamber 424 and combustion rotor 426 from the perspective of the rear of motor 100, with respect to which combustion rotor 426 rotates in a clockwise fashion. Furthermore, for the purpose of illustrating the principles of the present invention the sealing blades 436 associated with combustion rotor 426 are labeled as sealing blades 'A', 'B', 'C', and 'D' and the sub-chambers 606 of combustion chamber 424 are labeled as sub-chambers 'I', 'II', and 'III'.

Figure 11A:
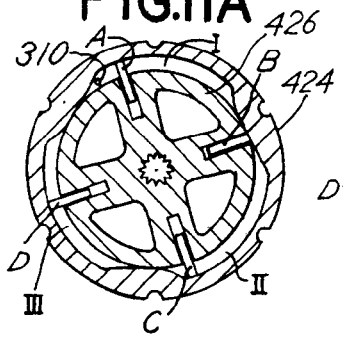
FIGS. 11A–11L are cross-sectional views illustrating a 360° rotation of a combustion rotor of FIG. 4 disposed within a combustion chamber of FIG. 4 in accordance with an embodiment of the present invention.
Figure 11B:
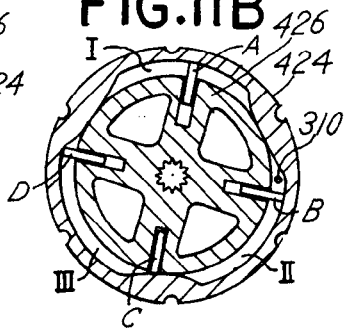
Figure 11C:
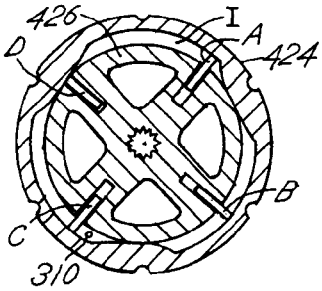
Figure 11D:
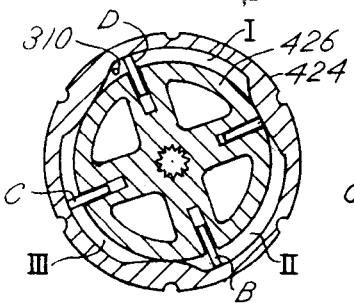
Figure 11E:
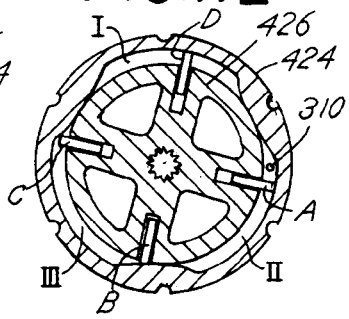
Figure 11F:
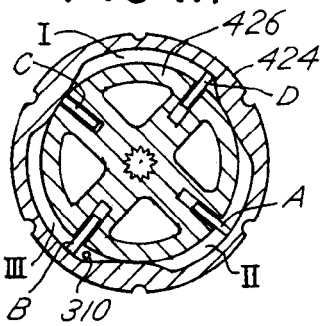
Figure 11G:
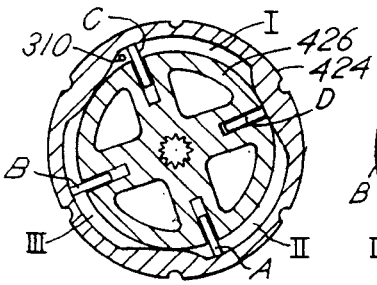
Figure 11H:
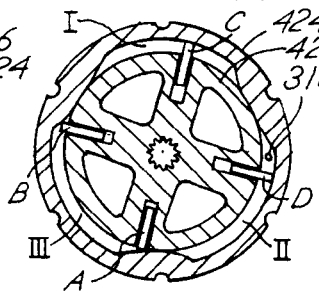
Figure 11I:
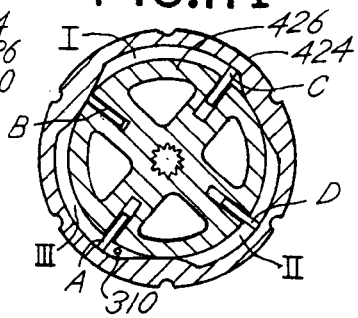
Figure 11J:
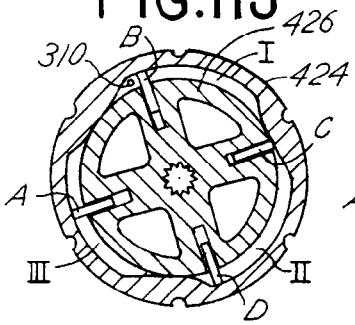
Figure 11K:
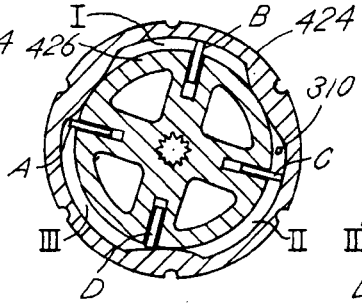
Figure 11L:
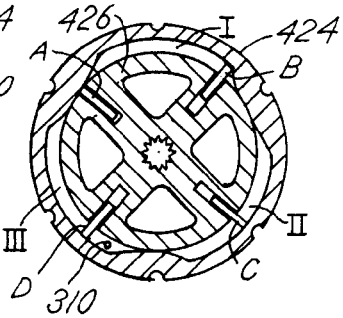

In each of FIGS. 11A–11L, an ignition of a compressed fuel mixture in one of sub-chambers I, II, or III as described above with respect to FIG. 10 impairs a clockwise torque on a sealing blade 436 positioned in the sub-chambers, thereby imparting a clockwise torque on combustion rotor 426 and shaft 110 (not shown). In FIG. 11A, a compressed fuel mixture provided to sub-chamber I of combustion chamber 424 is ignited by an ignition device 310 in the sub-chamber, imparting a clockwise torque on sealing blade A. In FIG. 11B, upon rotation of combustion rotor 426 approximately 30° from the rotor's position as depicted in FIG. 11A, a compressed fuel mixture provided to sub-chamber 11 of combustion chamber 424 is ignited by an ignition device 310 in the sub-chamber, imparting a clockwise torque on sealing blade B. In FIG. 11C, upon rotation of combustion rotor 426 approximately 30° from the rotor's position as depicted in FIG. 11B, a compressed fuel mixture provided to sub-chamber III of combustion chamber 424 is ignited by an ignition device 310 in the sub-chamber, imparting a clockwise torque on sealing blade C.

Similarly, each of FIGS. 11D–11L depicts a rotation of combustion rotor 426 approximately 30° from the rotor's position as depicted in the immediately preceding Figure. In each of FIGS. 11D–11L, a compressed fuel mixture provided to sub-chambers I, II, III, I, II, III, I, II, and III, respectively, imparting a clockwise torque on sealing blades D, A, B, C, D, A, B, C, and D, respectively. As is depicted in FIGS. 11A–11L, radial combustion motor 100 can produce 12 power strokes or combustion events that each imparts a torque on the combustion rotor and thereby on shaft 110, in a single 360° rotation of the rotor. As those who are of ordinary skill in the art realize, the number of power strokes per 360° rotation of combustion rotor 426 can be varied and is up to a designer of the radial combustion motor. Furthermore, as those who are of ordinary skill in the ail realize, the possible number of power strokes per 360° rotation of combustion rotor 426 is a function of the number of sealing blades 426 associated with rotor 426 and the number of sub-chambers 606 into which combustion chamber 424 is divided. By varying the number of sealing blades 426 and the number of sub-chambers 606, a nearly limitless number of power strokes may be possible per 360° rotation of combustion rotor 426 without departing from the spirit and scope of the present invention.

Those who are of ordinary skill in the art further realize that for each combustion event as depicted in FIGS. 11A–11L, there is a corresponding compression of a precompressed fuel mixture in a sub-chamber 506 of compression chamber 404 to produce a compressed fuel mixture that is then transferred to a sub-chamber 606 of combustion chamber 424 for ignition. For example, FIGS. 12A–12L depict the compression of a precompressed fuel mixture in each of the multiple sub-chambers 506 of compression chamber 404 to produce a compressed fuel mixture that is ignited in a corresponding sub-chamber 606 of combustion chamber 424 as depicted in FIGS. 11A–11L. Each of FIGS. 12A–12L is a cross-sectional view of compression chamber 404 and compression rotor 406 from the perspective of the rear of motor 100, with respect to which compression rotor 406 rotates in a clockwise fashion. For the purpose of illustrating the principles of the present invention, the sealing blades 416 associated with compression rotor 406 are labeled as sealing blades 'W', 'X', 'Y', and 'Z' and the sub-chambers 606 of combustion chamber 424 are labeled as sub-chambers 'IV', 'V', and 'VI'.

Figure 12A:
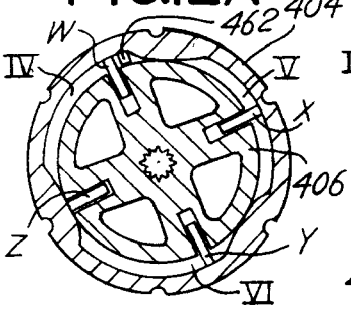
FIGS. 12A–12L, are cross-sectional views illustrating a 360° rotation of a compression rotor of FIG. 4 disposed within a compression chamber of FIG. 4 in accordance with an embodiment of the present invention.

In FIG. 12A, a precompressed fuel mixture provided to sub-chamber IV of compression chamber 404 is compressed by sealing blade W to produce a compressed fuel mixture. The compressed fuel mixture is transferred to sub-chamber I of combustion chamber 424 via a fuel return aperture 462 of transfer ring 418 and a fuel return aperture 464 of fixed transfer plate 420 (not shown) that is aligned with the displayed transfer ring aperture 462. The compressed fuel mixture transferred to sub-chamber I of combustion chamber 424 is then ignited and imparts a torque on sealing blade A as depicted in FIG. 11A.

Figure 12B:
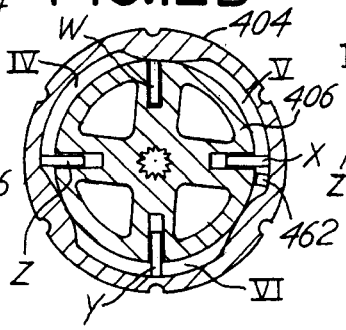

In FIG. 12B, compression rotor 406 is depicted as having rotated approximately 30° from the position of the rotor as depicted in FIG. 12A. In FIG. 12B, a precompressed fuel mixture provided to sub-chamber V of compression chamber 404 is compressed by sealing blade X to produce a compressed fuel mixture. The compressed fuel mixture is transferred to sub-chamber II of combustion chamber 424 via a fuel return aperture 462 of transfer ring 418 and a fuel return aperture 464 of fixed transfer plate 420 (not shown) that is aligned with the displayed transfer ring aperture 462. The compressed fuel mixture transferred to sub-chamber II is then ignited and imparts a torque on sealing blade B as depicted in FIG. 11B.

Figure 12C:
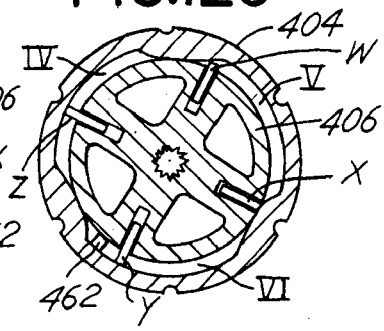
Figure 12D:
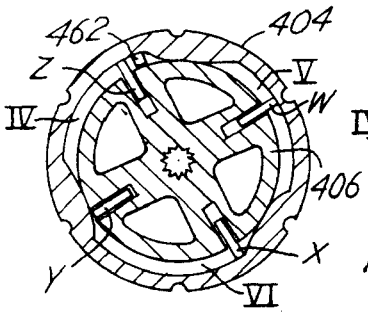
Figure 12E:
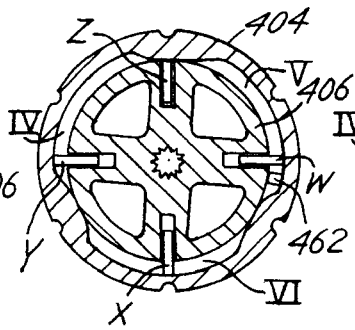
Figure 12F:
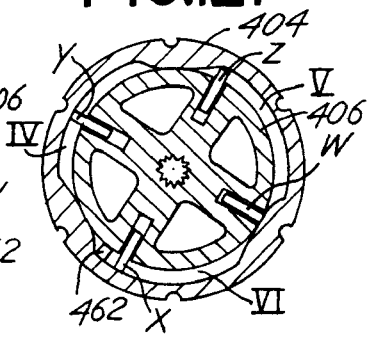
Figure 12G:
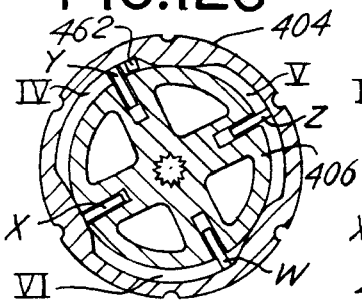
Figure 12H:
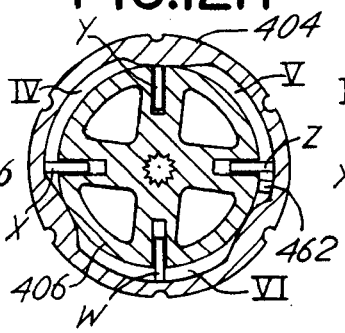
Figure 12I:
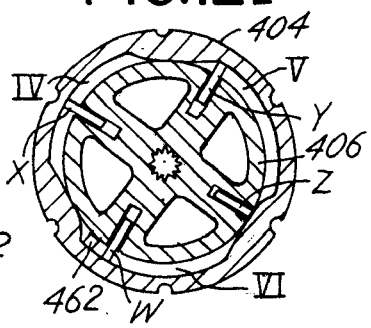
Figure 12J:
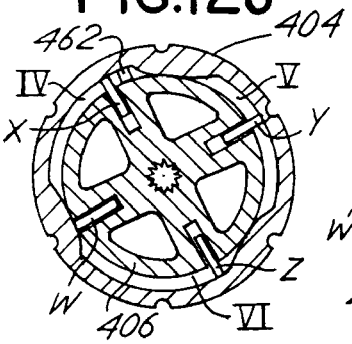
Figure 12K:
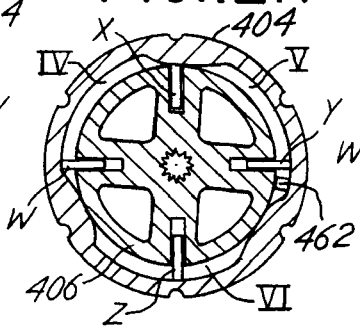
Figure 12L:
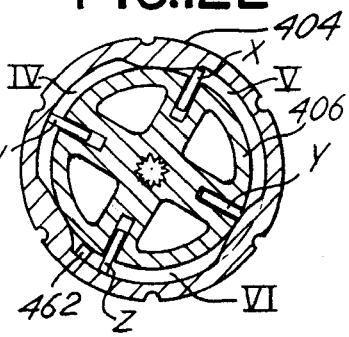

In FIG. 12C compression rotor 406 is depicted as having rotated approximately 30° from the position of the rotor as depicted in FIG. 12B. In FIG. 12C, a precompressed fuel mixture provided to sub-chamber VI of compression chamber 404 is compressed by sealing blade Y to produce a compressed fuel mixture. The compressed fuel mixture is transferred to sub-chamber III of combustion chamber 424 via a fuel return aperture 462 of transfer ring 418 and a fuel return aperture 464 of fixed transfer plate 420 (not shown) that is aligned with the displayed transfer ring aperture 462. The compressed fuel mixture transferred to sub-chamber III is then ignited and imparts a torque on sealing blade C as depicted in FIG. 11C.

Similarly, each of FIGS. 12D–12L depicts a rotation of compression rotor 406 approximately 30° from the rotor's position as depicted in the immediately preceding Figure. In each of FIGS. 12D–12L, a precompressed fuel mixture provided to sub-chambers IV, V, VI, IV, V, VI, IV, V, and VI, respectively, of compression chamber 404 is compressed by sealing blades Z, W, X, Y, Z, W, X, Y, and Z, respectively, to produce a compressed fuel mixture. Each compressed fuel mixture is transferred to corresponding sub-chambers I, II, III, I, II, III, I, II, and III, respectively, of combustion chamber 424 via a fuel return aperture 462 of transfer ring 418 and a fuel return aperture 464 of fixed transfer plate 420 (not shown) that is aligned with the displayed transferring aperture 462. Each compressed fuel mixture transferred to a sub-chamber 606 of combustion chamber 424 is then ignited and imparts a torque on sealing blade positioned in the sub-chamber as depicted in corresponding FIGS. 11D–11L.

As those who are of ordinary skill in the art realize, the number of compressions and transfers of a precompressed fuel mixture per 360° rotation of compression rotor 406 can be varied and is up to a designer of the radial combustion motor. Preferably, each combustion event has a corresponding compression and transfer event (i.e., a compression of a precompressed fuel mixture in a sub chamber 506 of compression chamber 404 to produce a compressed fuel mixture and a transfer of the compressed fuel mixture to a sub-chamber 606 of combustion chamber 424). Furthermore, as those who are of ordinary skill in the art realize, the possible number of compression and transfer events per 360° rotation of compression rotor 406 is a function of the number of sealing blades 416 associated with rotor 406 and the number of sub-chambers 506 into which compression chamber 404 is divided. By varying the number of sealing blades 416 and the number of sub-chambers 506, a nearly limitless number of compression and transfer events may be possible per 360° rotation of compression rotor 406 without departing from the spirit and scope of the present invention.

In sum, a radial combustion motor 100 is provided that uses sealing blades 416, 436 respectively associated with a compression rotor 406 and a combustion rotor 426 to compress a combustible fuel in a sub-chamber 506 of compression chamber 404 and to apply a torque to a rotor 426 and an associated shaft 110 in response to a combustion of the fuel in a sub-chamber 606 of combustion chamber 424. The sealing blades 416, 436 are positioned in their respective sub-chambers 506, 606 in response to a centrifugal force produced by a rotation of each respective rotor 460, 426, and do not require any rods to manipulate the positions of the sealing blades. The sealing blades, in conjunction with their corresponding rotors, also provide a compression seal for each of the compression sub-chambers 506 and a combustion seal for each of the combustion sub-chambers 606. The fuel is transferred among the multiple chambers of motor 100 via multiple fuel apertures 450–458 and fuel return apertures 460–464 and does not require any valves. Furthermore, after combustion of the fuel, the exhaust escapes a combustion sub-chamber 606 via one of multiple exhaust apertures 314 and again no valves are required. Radial combustion motor 100 further allows for as many power strokes per rotation of shaft 110 as there are sub-chambers 606 of combustion chamber 426, resulting in a low size-to-power ratio. The motor further includes a simple mechanical system for the synchronization of the timing of the ignition of fuel ignition devices positioned in the combustion sub-chambers 606 with the rotation of the combustion rotor 426, although other synchronization systems may be used herein without departing from the spirit and scope of the present invention.

Figure 13:
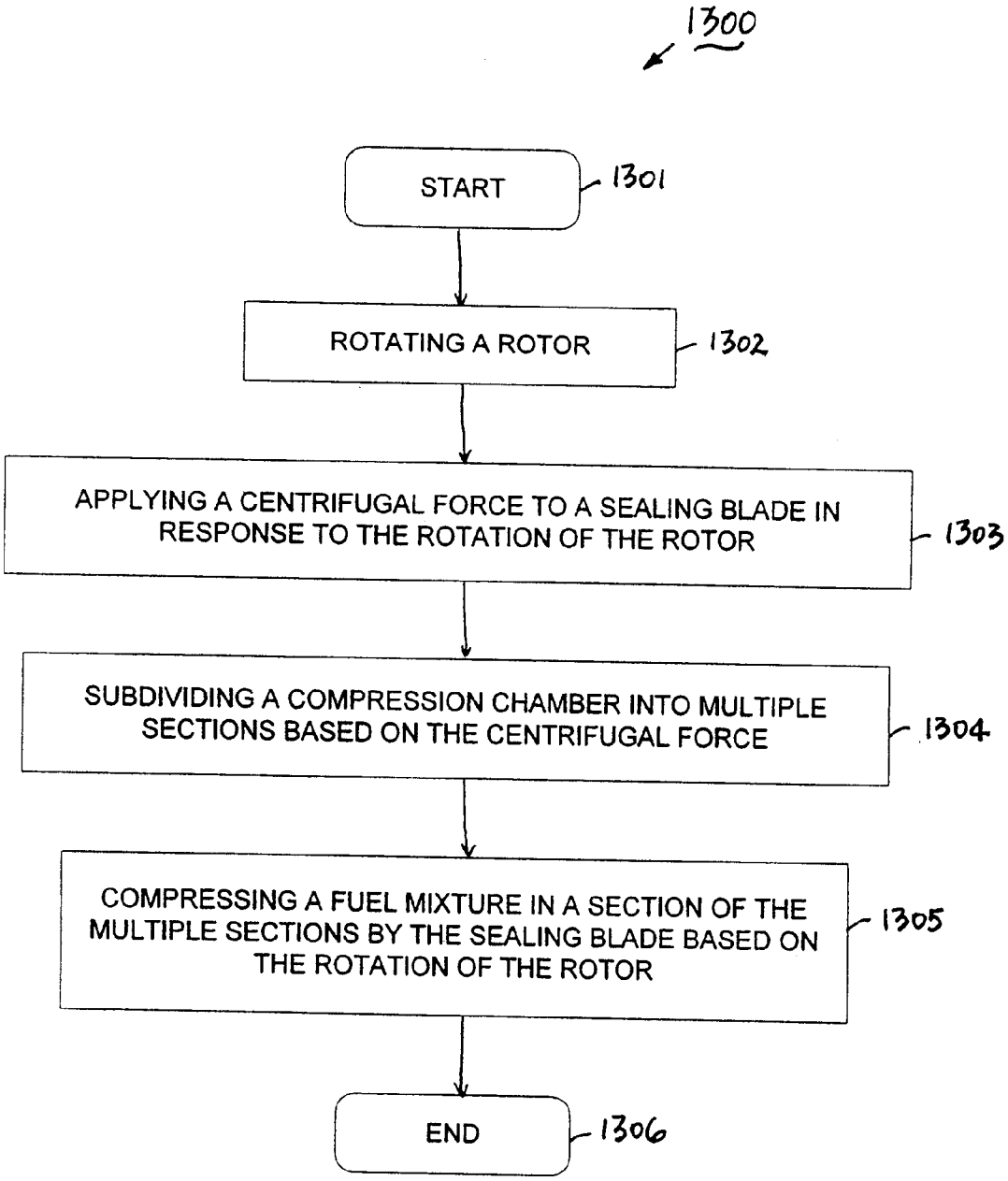
FIG. 13 is a logic flow diagram of the steps performed by a motor in order to compress a compressible fuel in accordance with an embodiment of the present invention

FIG. 13 is a logic flow diagram 1300 of the steps performed by a motor in order to compress a compressible fuel in accordance with an embodiment of the present invention, wherein the motor includes a rotor that is rotatably positioned in a compression chamber and wherein the rotor includes a sealing blade slot that slidably receives a sealing blade. The logic flow diagram begins (1301) with the rotating (1302) of the rotor. In response to the rotation of the rotor, a centrifugal force is applied (1303) to the sealing blade. The sealing blade subdivides (1304) the compression chamber into multiple sections based on the centrifugal force and compresses (1305) the fuel mixture in a section of the multiple sections by the sealing blade based on the rotation of the rotor, and the logic flow ends (1306).

Figure 14:
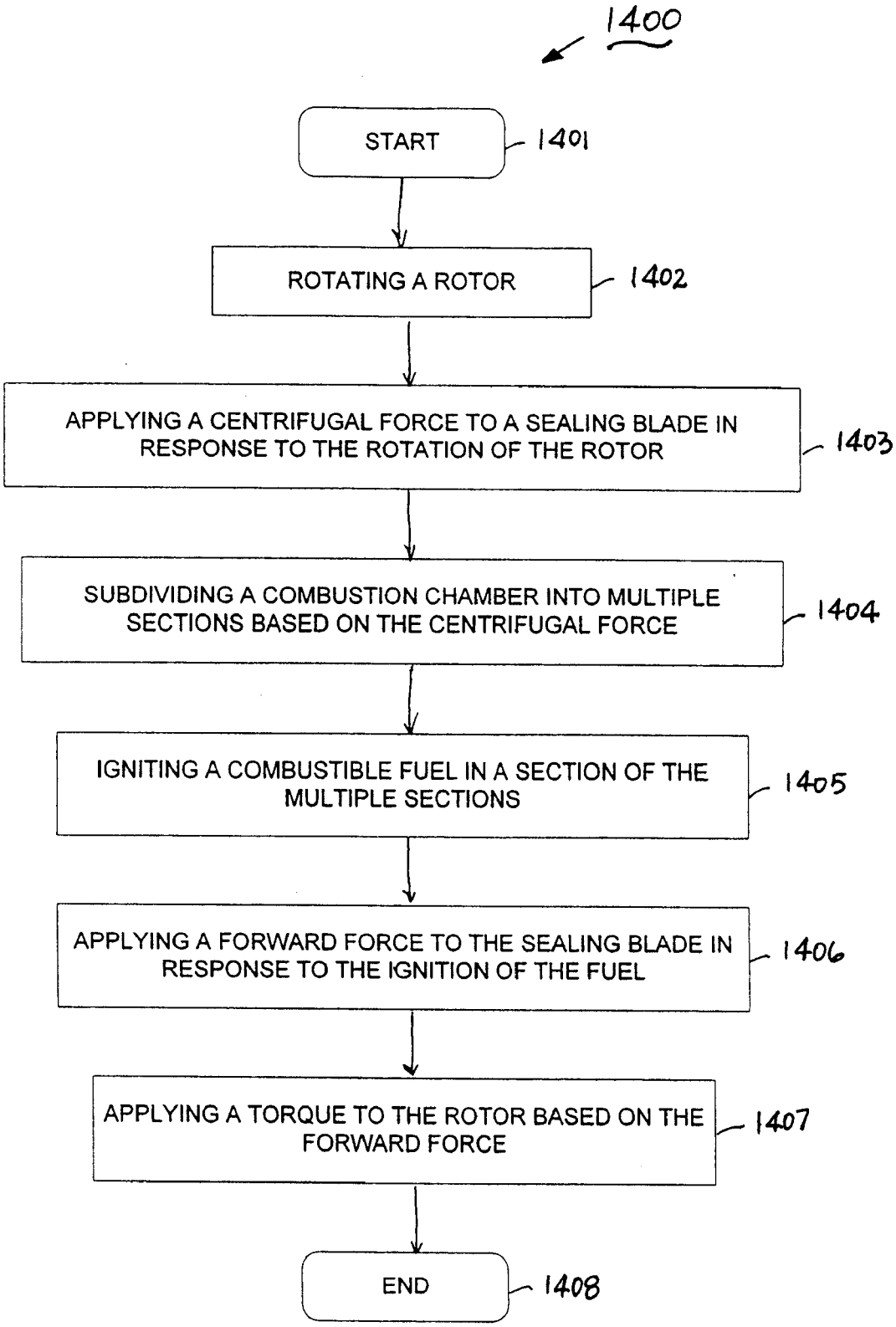
FIG. 14 is a logic flow diagram of the steps performed by a motor in order to generate a torque in accordance with an embodiment of the present invention.

FIG. 14 is a logic flow diagram 1400 of the steps performed by a motor in order to generate a torque in accordance with an embodiment of the present invention, wherein the motor includes a rotor that is rotatably positioned in a combustion chamber and wherein the rotor includes a sealing blade slot that slidably receives a sealing blade. The logic flow diagram begins (1401) with the rotating (1402) of the rotor. In response to the rotation of the rotor, a centrifugal force is, applied (1403) to the sealing blade. The sealing blade subdivides (1404) the combustion chamber into multiple sections based on the centrifugal force. A combustible fuel is ignited (1405) in a section of the multiple sections. In response to the ignition of the fuel, a forward force is applied (1406) to the sealing blade. A torque is applied (1407) to the rotor based on the forward force, and the logic flow ends (1408). In an alternative embodiment of the present invention, the rotor is coupled to a shaft, and the method further includes a step of applying a torque to the shaft based on the torque applied to the rotor.

As described above, a radial combustion motor is provided that compresses a fuel and generates a torque with fewer moving parts and a lower size-to-power ratio than conventional internal combustion engines. Since the radial combustion motor has fewer moving parts, it is easier and more economic to manufacture and repair than conventional internal combustion engines. While the present invention has been particularly shown and described with reference to particular embodiments thereof, it will be understood by those skilled in the art that various changes in form and details may be made therein without departing from the spirit and scope of the present invention. For example, the many apertures included in the present invention, such as the air intake apertures, fuel apertures, fuel return apertures, exhaust apertures, and ignition apertures, may be of any shape notwithstanding the rectangular, circular, or approximately triangular shapes ascribed to the various apertures in FIGS. 1–12L.

What is claimed is:

1. A radial combustion motor having a compression section comprising:

a compress ion block that houses a compression chamber, the compression chamber disposed in a fixed position in the compression block, the compression chamber comprises an inner wall and an outer wall, wherein the inner wall of the compression chamber comprises a plurality of ridges that each extend approximately a length of the compression chamber;

a compression rotor rotatably positioned in the compression chamber, wherein the compression rotor, in combination with the plurality of ridges of the compression chamber, divides an interior of the compression chamber into a plurality of sub-chambers, the compression rotor comprises a plurality of sealing blade slots positioned in an outer surface of the compression rotor for receiving a plurality of sealing blades, wherein each sealing blade of the plurality of seal blades is slidable received by a sealing blade slot of the plurality of sealing blade slots and wherein each sealing blade radially reciprocates in and out of the sealing blade slot when the compression rotor rotates inside of the compression chamber, thereby subdividing each sub-chamber;

an inner wall of the compression block and the outer wall of the compression chamber each comprises at least one locking pin slot for receiving a locking pin, wherein each locking pin slot of the inner wall of the compression block aligns with a corresponding locking pin slot of the outer wall of the compression chamber, and wherein the compression section further comprises a locking pin that is inserted into a locking pin slot of the compression chamber and a corresponding locking pin slot of the compression block ad that thereby locks the compression chamber into a fixed position relative to the compression block.

2. The radial combustion motor of claim 1, wherein the plurality of ridges in the compression chamber are approximately equally spaced around a circumference of the inner wall of the compression chamber.

3. The radial combustion motor of claim 1, wherein the radial combustion motor further comprises a shaft that is coupled to the compression rotor, and wherein a rotation of the shaft causes a rotation of the compression rotor.

4. The radial combustion motor of claim 1, wherein the combustion rotor comprises an outer layer and an inner layer of the combustion rotor, wherein the outer layer is composed of a first metallic material and the inner layer is composed of a second metallic material, and wherein the first metallic material is harder than the second metallic material.

5. The radial combustion motor of claim 1, wherein the compression rotor comprises an inner rotor of the compression rotor positioned inside of a sleeve, wherein the sleeve is composed of a first metallic material and the inner rotor is composed of a second metallic material, and wherein the first metallic material is harder than the second metallic material.

6. The radial combustion motor of claim 1, wherein an inner surface of the compression block and an outer surface of the compression chamber each comprises at least one locking pin slot for receiving a locking pin, wherein each locking pin slot of the inner surface of the compression block aligns with the corresponding locking pin slot of the outer surface of the compression chamber, wherein the compression chamber is locked in a fixed position relative to the compression block when the locking pin is inserted into a locking pin slot of the compression chamber and a corresponding locking pin slot of the compression block.

7. A radial combustion motor having a compression section comprising:

a compression block that houses a compression chamber, the compression chamber disposed in a fixed position in the compression block, the compression chamber comprises an inner wall and an outer wall, wherein the inner wall of the compression chamber comprises a plurality of ridges that each extend approximately a length of the compression chamber;

a compression rotor rotatably positioned in the compression chamber, wherein the compression rotor, in combination with the plurality of ridges of the compression chamber, divides an interior of the compression chamber into a plurality of sub-chambers, the compression rotor comprises a plurality of sealing blade slots positioned in an outer surface of the compression rotor for receiving a plurality of sealing blades, wherein each sealing blade of the plurality of seal blades is slidable received by a sealing blade slot of the plurality of sealing blade slots and wherein each sealing blade radially reciprocates in and out of the sealing blade slot when the compression rotor rotates inside of the compression chamber, thereby subdividing each sub-chamber;

a combustion block that houses a combustion chamber an inner wall and an outer wall and wherein the inner wall of the combustion chamber comprises a plurality of ridges that each extend approximately a length of the combustion chamber;

a combustion rotor rotatably disposed within the combustion chamber, wherein the combustion rotor, in combination with the plurality of ridges of the combustion chamber, divides an interior of the combustion chamber into a plurality of sub-chambers, a plurality of sealing blade slots positioned in an outer surface of the combustion rotor for receiving a plurality of sealing blades, wherein each sealing blade of the plurality of sealing blades is slidably received by a sealing blade slot of the plurality of sealing blade slots and wherein each sealing blade radially reciprocates in and out of the sealing blade slot when the rotor rotates inside of the combustion chamber, thereby subdividing each sub-chamber; and an inner wall of the combustion block and an outer wall of the combustion chamber each comprising at least one locking pin slot for receiving a locking pin, wherein each locking pin slot of the inner wall of the combustion block aligns with the corresponding locking pin slot of the outer wall of the combustion chamber, wherein the combustion chamber is locked into a fixed position relative to the combustion block when the locking pin is inserted into a locking pin slot of the combustion chamber and a corresponding locking pin slot of the combustion block and that thereby locks the combustion chamber into a fixed position relative to the combustion block.

8. The radial combustion motor of claim 7, wherein the plurality of ridges in the combustion chamber are approximately equally spaced around a circumference of the inner wall of the combustion chamber.

9. The radial combustion motor of claim 7, wherein the compression block further comprises an air intake aperture and the combustion block further comprises an air intake aperture, wherein that intake aperture of the combustion block is aligned with the air intake aperture of the compression block, wherein the carburetor receives air via the air intake apertures of the compression block and the combustion block, mixes the air with a fuel to produce a fuel mixture, and conveys the fuel mixture to the combustion section.

10. The radial combustion motor of claim 9, wherein the combustion rotor comprises a combustion rotor fuel aperture that receives the fuel mixture produced by the carburetor and wherein the combustion rotor, when rotating, propels the fuel mixture through the combustion chamber via the combustion rotor fuel aperture.

11. The radial combustion motor of claim 10, further comprising a carburetor plate affixed to the combustion block and disposed between the combustion section and the carburetor, and wherein the carburetor plate comprises:

a carburetor plate air intake aperture that is aligned with the air intake aperture of the combustion block and that allows air to flow through the carburetor plate to the carburetor, and a carburetor plate fuel aperture that allows the fuel mixture produced by the carburetor to flow through the carburetor plate to the combustion rotor fuel aperture.

12. The radial combustion motor of claim 11, further comprising a shaft that is coupled to each of the combustion rotor and the compression rotor, and wherein a rotation of the combustion rotor causes a rotation of the shaft, that in turn causes a rotation of the compression rotor.

13. The radial combustion motor of claim 11, wherein the radial combustion motor further comprises a transfer plate that is disposed between the combustion section, and the compression section, wherein the transfer plate comprises an air intake aperture that is aligned with each of the combustion block air intake aperture and the compression block air intake aperture, and wherein the transfer plate air intake aperture allows air to flow from the compression block air intake aperture to the combustion block air intake aperture.

14. The radial combustion motor of claim 13, wherein the transfer plate further comprises a fuel aperture that allows the fuel mixture to flow from the combustion chamber to the compression chamber.

15. The radial combustion motor of claim 14, wherein the compression rotor further comprises a compression rotor fuel aperture that receives the fuel mixture from the combustion section and wherein the compression rotor, when rotating, propels the fuel mixture through the compression chamber via the compression rotor fuel aperture.

16. The radial combustion motor of claim 15, further comprising a precompression chamber disposed on the opposite side of the compression section from the combustion section that receives the fuel mixture from the compression rotor.

17. The radial combustion motor of claim 16, further comprising a precompression chamber plate disposed between the compression section and the precompression chamber, wherein the precompression chamber plate comprises:

an air intake aperture that is aligned with the air intake aperture of the compression block and that allows air to flow through the precompression chamber plate to the air intake aperture of the compression block;

a fuel aperture that allows for the fuel mixture to flow from the compression rotor, through the precompression chamber plate, to the precompression chamber; and a fuel return aperture that allows for the fuel mixture received by the precompression chamber from the compression rotor to flow from the precompression chamber, through the precompression chamber plate, to a sub-chamber of the plurality of sub-chambers of the compression chamber.

18. The radial combustion motor of claim 17, wherein the compression section further comprises a fuel transfer disk affixed to the compression rotor and disposed between the compression rotor and the transfer plate, the fuel transfer disk comprising:

a fuel aperture that allows for the passage of the fuel mixture from the combustion section to the compression rotor;

a fuel return aperture that allows for the passage of a compressed fuel mixture from the compression chamber sub-chamber to the combustion section;

wherein rotation of the compression rotor causes a movable sealing blade of the plurality of movable sealing blades to subdivide the compression chamber sub-chamber and thereby to compress the fuel mixture received by the compression chamber sub-chamber from the precompression chamber to produce the compressed fuel mixture; and wherein the transfer plate further comprises a fuel return aperture that aligns with the fuel return aperture of the fuel transfer disk for a portion of every rotation of the compression rotor and wherein the alignment of the transfer plate fuel return aperture with the fuel transfer disk fuel return aperture allows for the transfer of the compressed fuel mixture from the compression chamber sub-chamber to a sub-chamber of the plurality of sub-chambers of the combustion chamber.

19. The radial combustion motor of claim 18, wherein the carburetor plate further comprises an ignition aperture for receiving a fuel ignition device, which fuel ignition device is capable of igniting the compressed fuel mixture in the combustion chamber sub-chamber.

20. The radial combustion motor of claim 19, further comprising:

a fuel ignition device positioned in the ignition aperture that ignites the compressed fuel mixture in the combustion chamber sub-chamber; and an ignition controller that is synchronized with the rotation of the combustion rotor and that provides a control signal to the fuel ignition device, which control signal causes the fuel ignition device to ignite the fuel stored in the combustion chamber sub-chamber and thereby causes rotation of the combustion rotor.

21. The radial combustion motor of claim 20, wherein the carburetor plate further comprises an exhaust aperture for the expulsion of exhaust from the combustion chamber sub-chamber.

22. The radial combustion motor of claim 21, wherein the ignition controller comprises:

a switching device that is synchronized with the rotation of the combustion rotor;

a voltage source that is connected to the switching device; and wherein rotation of the shaft enables the switching device, thereby causing the ignition controller to convey a voltage to the fuel ignition device.

23. The radial combustion motor of claim 22, wherein the switching device includes a latch that is disposed in contact with the shaft and approximately perpendicular to an axis of rotation of the shaft, and wherein the rotation of the shaft causes an adjustment in a position of the latch, which adjustment causes an enabling of the switching device.

24. The radial combustion motor of claim 7, wherein the combustion rotor comprises a combustion rotor fuel aperture that receives intake air, and wherein the combustion rotor, when rotating, propels the intake air through the combustion chamber via the combustion rotor fuel aperture, a compression rotor fuel aperture in the compression rotor that receives the intake air from the combustion section, wherein the compression rotor, when rotating, propels the fuel mixture through the compression chamber via the compression rotor fuel aperture, and a transfer plate disposed between the combustion section and the compression section, wherein the transfer plate comprises a fuel aperture that allows the intake air to flow from the combustion chamber to the compression chamber.

25. The radial combustion motor of claim 24, further comprising:

a precompression chamber disposed on the opposite side of the compression section from the combustion section that receives the intake air from the compression rotor;

a precompression chamber plate disposed between the compression, section and the precompression chamber that comprises:

a fuel aperture that allows for the intake air to flow from the compression rotor, through the precompression chamber plate, to the precompression chamber; and a fuel return aperture that allows for the intake air received by the precompression chamber from the compression rotor to flow from the precompression chamber, through the precompression chamber plate, to a sub-chamber of the plurality of sub-chambers of the compression chamber.

26. The radial combustion motor of claim 25, wherein the compression section further comprises a fuel transfer disk affixed to the compression rotor and disposed between the compression rotor and the transfer plate, the fuel transfer disk comprising:

a fuel aperture that allows for the passage of the intake air from the combustion section to the compression rotor;

a fuel return aperture that allows for the passage of compressed air from the compression chamber sub-chamber to the combustion section;

wherein rotation of the compression rotor causes a movable sealing blade of the plurality of movable sealing, blades to subdivide the compression chamber sub-chamber and thereby to compress the intake air received by the compression chamber sub-chamber from the precompression chamber to produce compressed air; and wherein the transfer plate further comprises a fuel return aperture that aligns with the fuel return aperture of the fuel transfer disk for a portion of every rotation of the compression rotor and wherein the alignment of the transfer plate fuel return aperture with the fuel transfer disk fuel return aperture allows for the transfer of the compressed air from the compression chamber sub-chamber to a sub-chamber of the plurality of sub-chambers of the combustion chamber.

27. The radial combustion motor of claim 26, further comprising:

a plate disposed on the opposite side of the combustion section from the compression section, wherein the plate comprises an ignition aperture for receiving a fuel ignition device and wherein the plate further comprises a fuel injection aperture for receiving a fuel injection device:

a fuel injection device positioned in the fuel injection aperture that injects a combustible fuel into the combustion chamber sub-chamber:

an injection controller that is synchronized with the rotation of the combustion rotor and that provides a control signal to the injection device, which control signal causes the injection device to inject a fuel into in the combustion chamber sub-chamber;

a fuel ignition device that-ignites the fuel in the combustion chamber sub-chamber;

an ignition controller that is synchronized with the rotation of the combustion rotor and that provides a control signal to the fuel ignition device, which control signal causes the fuel ignition device to ignite the fuel in the combustion chamber sub-chamber and thereby causes rotation of the combustion rotor; and a shaft that is coupled to each of the combustion rotor and the compression rotor, and wherein a rotation of the combustion rotor causes a rotation of the shaft, that in turn causes a rotation of the compression rotor.

28. A radial combustion motor having a compression section comprising:

a compression block;

a compression chamber disposed in a fixed position in the compression block that comprises an inner wall and an outer wall, wherein the inner wall of the compression chamber comprises a plurality of ridges that each extend approximately a length of the compression chamber;

a compression rotor that is rotatably positioned in the compression chamber, wherein the compression rotor, in combination with the plurality of ridges of the compression rotor chamber, divides an interior of the compression chamber into a plurality of sub-chambers;

a plurality of sealing blade slots positioned in an outer surface of the compression rotor for receiving a plurality of sealing blades; wherein each sealing blade of the plurality of seal blades is slidable received by a sealing blade slot of the plurality of sealing blade slots and wherein each sealing blade radially reciprocates in and out of the sealing blade slot when the rotor rotates inside of the compression chamber, thereby subdividing each sub-chamber; and an inner wall of the compression block and an outer wall of the compression chamber each comprises at least one locking pin slot for receiving a locking pin, wherein each locking pin slot of the inner wall of the compression block aligns with the corresponding locking pin slot of the outer wall of the compression chamber, wherein the compression chamber is locked in a fixed position relative to the compression block when the locking pin is inserted into a locking pin slot of the compression chamber and a corresponding locking pin slot of the compression block.

29. The radial combustion motor of claim 28, wherein the plurality of ridges in the combustion chamber are approximately equally spaced around a circumference of the inner wall of the combustion chamber.

30. The radial combustion motor of claim 28, further comprising a carburetor disposed adjacent to the combustion section, wherein the combustion block further comprises an air intake aperture, wherein the carburetor receives air via the air intake aperture of the combustion block, mixes the air with a fuel to produce a fuel mixture, and conveys the fuel mixture to the combustion section.

31. The radial combustion motor of claim 30, wherein the fuel mixture produced by the carburetor is conveyed to a sub-chamber of the plurality of sub-chambers of the combustion chamber and wherein the fuel mixture is ignited in the sub-chamber.

32. The radial combustion motor of claim 28, further comprising a shaft that is coupled to the combustion rotor wherein a rotation of the combustion rotor causes a rotation of the shaft.

33. The radial combustion motor of claim 28, a plate affixed to the combustion block, wherein the plate comprises an ignition aperture for receiving a fuel ignition device that is capable of igniting a compressed fuel mixture in a sub-chamber of the combustion chamber.

34. The radial combustion motor of claim 33, further comprising:

a fuel ignition device positioned in the ignition aperture that ignites the compressed fuel mixture in the sub chamber of the combustion chamber; and an ignition controller that is synchronized with the rotation of the combustion rotor and that provides a control signal to the fuel ignition device, which control signal causes the fuel ignition device to ignite the fuel stored in the combustion chamber sub-chamber and thereby causes rotation of the combustion rotor.

35. The radial combustion motor of claim 34, wherein the carburetor plate further comprises an exhaust aperture for the expulsion of exhaust from the combustion chamber sub-chamber.

36. The radial combustion motor of claim 35, wherein the ignition controller comprises:

a switching device that is synchronized with the rotation of the combustion rotor;

a voltage source that is connected to the switching device; and wherein rotation of the shaft enables the switching device, thereby causing the ignition controller to convey a voltage to the fuel ignition device.

37. The radial combustion motor of claim 36, wherein the switching device includes a latch that is disposed in contact with the shaft and approximately perpendicular to an axis of rotation of the shaft, and wherein the rotation of the shaft causes an adjustment in a position of the latch, which adjustment causes an enabling of the switching device.

38. The radial combustion motor of claim 28, wherein the combustion rotor comprises an outer layer and an inner layer of the combustion rotor, wherein the outer layer is composed of a first metallic material and the inner layer composed of a second metallic material, and wherein the first metallic material is harder than the second metallic material.

39. The radial combustion motor of claim 31, wherein the combustion rotor comprises an inner rotor in the combustion rotor positioned inside of a sleeve, wherein the sleeve is composed of a first metallic material and the inner rotor is composed of a second metallic material, and wherein the first metallic material is harder than the second metallic material.

* * * * *

UNITED STATES PATENT AND TRADEMARK OFFICE

CERTIFICATE OF CORRECTION

PATENT NO. : 6,467,450 B1
DATED : October 22, 2002
INVENTOR(S) : Daniel Esteban Arce It is certified that error appears in the above-identified patent and that said Letters Patent is hereby corrected as shown below:

Title page,
Item [57], ABSTRACT,
Line 1, should read -- "A radial combustion motor is provided that includes a" --

Column 3,
Line 51, should read -- "the present invention. As shown in FIG. 1, motor 100" --

Column 4,
Line 9, should read -- "plate 126. Further, each latch 120 is disposed in an approxi-" --
Line 63, should read -- "each coupled by an enclosed air passageway, such was a" --

Column 5,
Line 35, should read -- "compression chamber 404, which compression chamber is" --

Column 6,
Line 3, should read -- "angular distance, around the circumference of rotor 406." --
Line 24, should read -- "embodiment of the present invention, transfer ring 418 may" --
Line 49, should read -- "thereby, providing a mechanical coupling between shaft 110" --

Column 7,
Line 6, should read -- "As is described in greater detail below, passage of the sealing" --
Line 47, should read -- "locks combustion chamber 424 into a fixed position relative" --

Column 9,
Line 27, should read -- "406, 426, with the result that each of the multiple power" --

Column 10,
Line 33, should read -- "ments of the present invention, ignition and exhaust plate 444" --
Line 39, should read -- "tures 314. Each of the multiple air intake apertures 112," --
Line 46, should read -- "plate 444 and carburetor plate 306. The fuel ignition device" --

UNITED STATES PATENT AND TRADEMARK OFFICE

CERTIFICATE OF CORRECTION

PATENT NO. : 6,467,450 B1
DATED : October 22, 2001
INVENTOR(S) : Daniel Esteban Arce It is certified that error appears in the above-identified patent and that said Letters Patent is hereby corrected as shown below:

Column 11,
Line 13, should read -- "of aligned apertures. Each bolt 130 is then secured in place by" --
Line 18, should read -- "devices 310 with the sub-chambers 606 of combustion" --
Line 32, should read -- "compression block 402. Each of the combustion block 422" --

Column 12,
Line 31, should read -- "air, or air and lubricant mixture, is compressed in a sub-" --

Column 15,
Line 28, should read -- "426 and shaft 110) rotates in a clockwise fashion. However," --

Column 16,
Line 62, should read -- "FIG. 10A. Sealing blade 436 divides sub-chamber 606 into" --

Column 17,
Line 20, should read -- "applies a torque to, and causes a clockwise rotation of ," --

UNITED STATES PATENT AND TRADEMARK OFFICE

CERTIFICATE OF CORRECTION

PATENT NO. : 6,467,450 B1
DATED : October 22, 2001
INVENTOR(S) : Daniel Esteban Arce It is certified that error appears in the above-identified patent and that said Letters Patent is hereby corrected as shown below:

Column 17, (cont'd)
Line 31, should read -- "In FIG. 10C, rotor 426 has rotated a sufficient clockwise" --
Line 62, should read -- "compressed fuel mixture provided to sub-chamber II of" --

Column 18,
Line 18, should read -- " Furthermore, as those who are of ordinary skill in the art" --

Column 21,
Line 7, should read -- "a compression block that houses a compression chamber," --

Signed and Sealed this

First Day of April, 2003

JAMES E. ROGAN
*Director of the United States Patent and Trademark Office*